United States Patent [19]

Jaton

[11] 4,222,311

[45] Sep. 16, 1980

[54] PROCESS AND SYSTEM FOR PRODUCING FOLDED BOXES

[75] Inventor: Jean P. Jaton, Chapelle, Switzerland

[73] Assignee: J. Bobst & Fils S.A. Lausanne, Switzerland

[21] Appl. No.: 910,755

[22] Filed: May 30, 1978

[30] Foreign Application Priority Data

Jun. 3, 1977 [CH] Switzerland ..... 06847/77

[51] Int. Cl.[3] ..... B31B 1/04

[52] U.S. Cl. ..... 93/36 M; 93/36 R; 93/49 R; 93/58 R; 414/95; 414/102

[58] Field of Search ..... 93/36 R, 58 R, 49 R, 93/49 M, 36 M, 52; 414/102, 95, 110, 37, 125–127, 608

[56] References Cited

U.S. PATENT DOCUMENTS

| | | | |
|---|---|---|---|
| 1,983,708 | 12/1934 | Ruble et al. | 93/58 R |
| 2,035,857 | 3/1936 | Adsit | 93/58 R |
| 3,292,504 | 12/1966 | Gres | 93/49 AC |
| 3,363,781 | 1/1968 | Magnetti | 414/102 X |
| 3,374,714 | 3/1968 | Berghgracht | 93/93 DP |
| 3,583,579 | 6/1971 | Triggs et al. | 414/37 X |

*Primary Examiner*—James F. Coan

*Attorney, Agent, or Firm*—Hill, Van Santen, Steadman, Chiara & Simpson

[57] ABSTRACT

An improved process and system for producing folded boxes which system includes a device for printing sheets of material with the configuration of boxes, a device for die cutting the box blanks from the printed sheets and producing piles of box blanks, a folding and gluing machine to form a folded box from the box blank, characterized by a device for transferring the piles of box blanks between a discharge of the device for die cutting and a receiving station of the folding and gluing machine. The transfer device includes means for loading at least one pile of box blanks onto an empty pallet, a conveyor for conveying the loaded pallet to a storage area of loaded pallets, a device for removing a loaded pallet from the storage area and transporting the loaded pallet individually to an unloading station, a device for unloading each of the piles disposed on a loaded pallet to form an empty pallet and transporting the piles to the receiving station, a conveyor device to transport the empty pallets to a storage station for empty pallets and a device for removing the empty pallets from the storage station and transporting the empty pallets to the device for loading piles thereon. Preferably, the system includes two stacking units and two unstacking units which are utilized to stack the loaded pallets into a stack of loaded pallets for transfer to the storage area and unstacking device for unstacking the pallets prior to being conveyed to the unloading device for unstacking the pallets prior to being conveyed to the unloading station, a second stacking device for stacking the empty pallets into a stack of empty pallets for transfer to the storage station and a second unstacking device for unstacking the empty pallets prior to being conveyed to the loading station.

18 Claims, 34 Drawing Figures

PROCESS AND SYSTEM FOR PRODUCING FOLDED BOXES

BACKGROUND OF THE INVENTION

1. Field of the Invention

The present invention is directed to a system and a process for producing folded boxes which includes printing sheets of materials with the configuration of boxes, means for die cutting the box blanks from the printed sheets, folding and gluing the box blanks into folded boxes and packing the folded boxes with a means for transferring the box blanks from a die cutting means to the folding and gluing apparatus.

2. Prior Art

Systems for producing folded boxes, which are usually found in board converting factories, generally consist of printing press for processing a sheet of material or board, which sheet is either a continuous sheet stored on reels or individual sheets. The printing press, which prints the configuration of the boxes on the sheets, can either be coupled directly with a die cutting platen or can be included in an integral unit which includes a die cutting station. Ultimately, the box blanks, which are produced by the die cutter, are delivered in piles from the die cutting station and are transported to a folding and gluing machine which forms a folded and glued box, which is subsequently handled in a packing station, which is also referred to as an automatic delivery station.

A problem inherent with such a system of forming folded boxes is the fact that it requires a large amount of handling by persons for transferring the piles of box blanks produced by the printer-cutter to the folding and gluing machine. For example, such a system will require a staff for removing the box piles from the outlet of the printer cutter as well as a staff for feeding box blanks to the folding and gluing machine.

SUMMARY OF THE INVENTION

The present invention is directed to a system and method which reduces the amount of handling by personnel between various operations which are carried out when forming folded boxes. To accomplish this aim, the system for producing folded boxes, which system includes means for printing sheets of materials with the configuration of boxes, means for die cutting box blanks from the printed sheets of material and producing piles of box blanks, means for folding and gluing a box blank to form a folded box and means for packing the folded boxes, has an improvement which comprises means for transferring the pile of box blanks between a discharge of the means for die cutting and a receiving station of the means for folding and gluing the boxes, said means for transferring comprising means for loading at least one pile of box blanks onto an empty pallet to form a loaded pallet, means for conveying the loaded pallet to a storage area of loaded pallets, means for removing the loaded pallet from the storage area and transporting the loaded pallet individually to an unloading station, means for unloading each of the piles disposed on the loaded pallet to form an empty pallet and transporting the piles to the receiving station, means for conveying each of the empty pallets to the storage station for empty pallets and means for removing an empty pallet from the storage station and transporting the empty pallet to the means for loading piles thereon. Preferably, the means for conveying the loaded pallet includes a first stacking station for loaded pallets having means disposed at the stacking station for stacking the loaded pallet with at least one other loaded pallet to form a stack of loaded pallets which is conveyed to the storage area, the means for removing a loaded pallet removes a stack of loaded pallets and transports the stack to a first unstacking station, which has first means for removing an unloaded pallet from the stack successively, the means for transporting or conveying each of the empty pallets includes a second stacking station having second means for stacking empty pallets into a stack of empty pallets, which stack of empty pallets are transported to the storage station and the means for transporting the empty pallets to the means for loading piles includes a second unstacking station having second means for unstacking empty pallets from the stack of empty pallets.

The invention is also directed to a method for feeding box blanks to a box blank processing machine from a shaping machine and comprises providing individual empty pallets from a stack of empty pallets, loading piles of box blanks received from the shaping machine onto the empty pallet to form a loaded pallet, stacking the loaded pallet with a given number of other loaded pallets to form a stack of loaded pallets, conveying the stack of loaded pallets into a storage station, removing a stack of loaded pallets from the storage station and conveying it to an unstacking station for loaded pallets, removing each of the loaded pallets from the stack of unloaded pallets at the unstacking station and sequentially transporting each of the unloaded pallets to an unloading station, unloading the piles of blanks from the pallet at the unloading station and transporting the piles of blanks to a receiving station of the box blank process machine, transporting the unloaded or empty pallets to a stacking station for empty pallets, stacking the empty pallets into a stack of empty pallets of a given number and then transporting the stack of empty pallets to storage area, transporting a stack of empty pallets to an unstacking station for empty pallets which unstack the pallets and provides them successively one at a time for loading piles of blanks.

DESCRIPTION OF THE PREFERRED EMBODIMENTS

Figure 1:
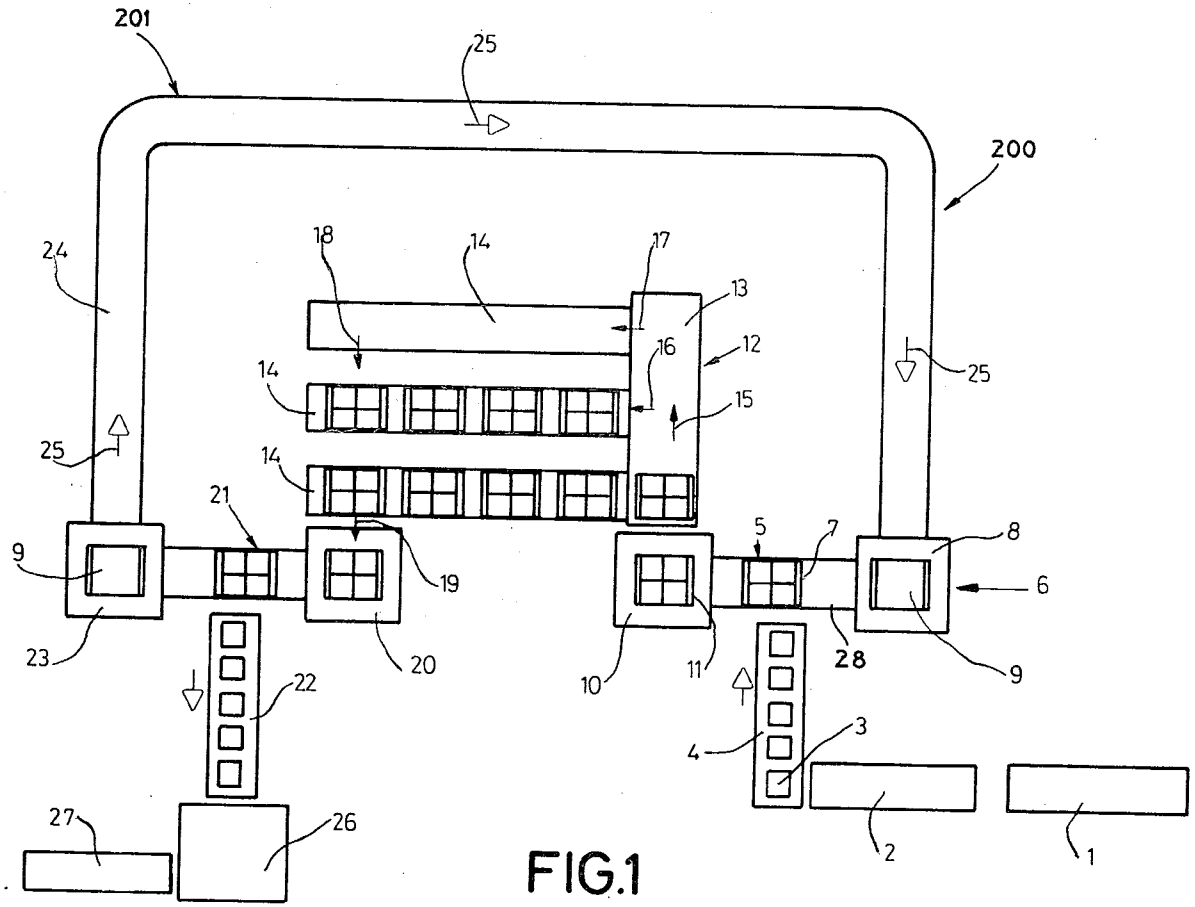
FIG. 1 is a general schematic view of the system in accordance with the present invention.

The principles of the present invention are particularly useful in a system for producing folded boxes which is schematically illustrated in FIG. 1 and generally indicated at 200. The system 200 includes means for printing sheets of material with the configuration of boxes and means for die cutting the box blanks from the printed sheets of material and producing piles of box blanks as schematically illustrated by box 1 for a printer cutter. The printing device and the die cutting device may be either a single continuous unit or separate units which have been interconnected or coupled together. From the printer cutter 1, the blanks are received in a piling and pile turning station 2, which is a discharge for the means for die cutting, and are assembled in a pile 3 and turned so that the print surface is facing downward as they are disposed on a conveyor or feeding device 4. From the pile turner 2, the piles of box blanks are transferred by means of transferring generally indicated at 201 to a receiving station 26 of means 27 for folding and gluing each box blank to form a folded box and as illustrated includes means for packaging the folded boxes. The means 26 for receiving may be a preparatory station, which includes devices for preparing the box blanks for entering the means 27 for folding and gluing which is a folding and gluing machine.

The means for transferring 201 as illustrated includes a conveyor for feeding device 4 for transporting or conveying the piles 3 to an inlet 5 of a palletizer 6. At the inlet 5, the piles 3 are loaded onto a pallet 7, which is carried on a conveyor 28 from a second unstacking station 8 where empty pallets 7 are removed or unstacked from a stack 9 of empty pallets. After the pallet 7 has been loaded with several piles of box blanks (four piles being illustrated), it is conveyed to a first stacking station 10 for piling or stacking loaded or full pallets into a stack 11 of full pallets.

After the full pallet has been formed into a stack 11 of full pallets of a given number of pallets, it is transferred or conveyed into a storage station generally indicated at 12 which includes a conveyor assembly 13 as well as various conveying and storing devices 14, three of which are illustrated. The stacks 11 of full pallets are conveyed into the storage station 12 as shown by the arrows 15, 16 and 17. From the storage station 12, a stack 11 of full pallets has been withdrawn when required and conveyed in the direction of arrows 18 and 19 to a first unstacking station 20 for unstacking full pallets from a stack 11 of full pallets.

As the loaded pallet is removed from the stack 11 at the first unstacking station 20, one by one and in sequence, it is conveyed to a box blank supply station 21 which includes an unloading station which unloads the piles from the loaded pallet and places them on a conveyor 22 to produce an empty pallet which is conveyed to a second piling or stacking station 23, where it is joined with other empty pallets to form a stack 9 of empty pallets. From the second station 23 the stack 9 of empty pallets is put upon a roller track 24 and conveyed in the direction 25 to the second unstacking station 8 where the empty pallets are unstacked and fed to the loading device. It should be noted that the roller track 24 acts as a storage device for several stacks 9 of empty pallets.

After the piles 3 of box blanks have been disposed on the conveyor means 22, they are transported to a receiving station 26 which includes a preparatory means for preparing the blanks prior to feeding into the means 27 for folding and gluing to form folded and glued boxes. The folded and glued boxes are then subsequently handled by a packaging unit to form packages of folded and glued boxes or may be directly delivered to a filling machine which will actually fill the boxes to complete the packaging system.

As illustrated, the means 201 for transferring forms means for moving a pallet through a cycle with a loading station, a storage station and a pile unloading station. Thus, a pallet will be loaded, placed in storage, removed from storage, unloaded, and then transported to a place or position to repeat the cycle.

Figure 2:
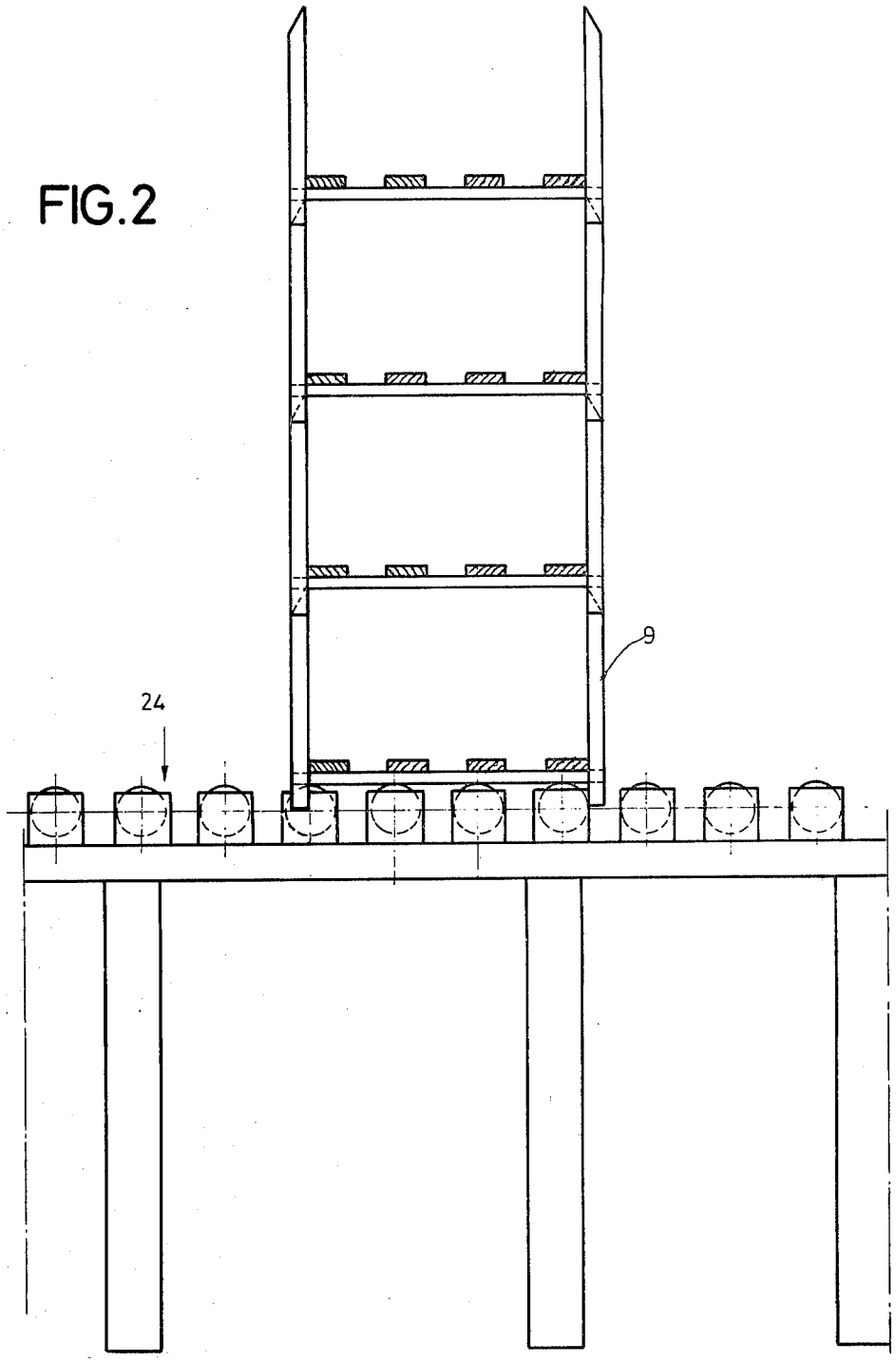
FIG. 2 is a side view illustrating a portion of the device for transporting a stack of empty pallets.
Figure 3:
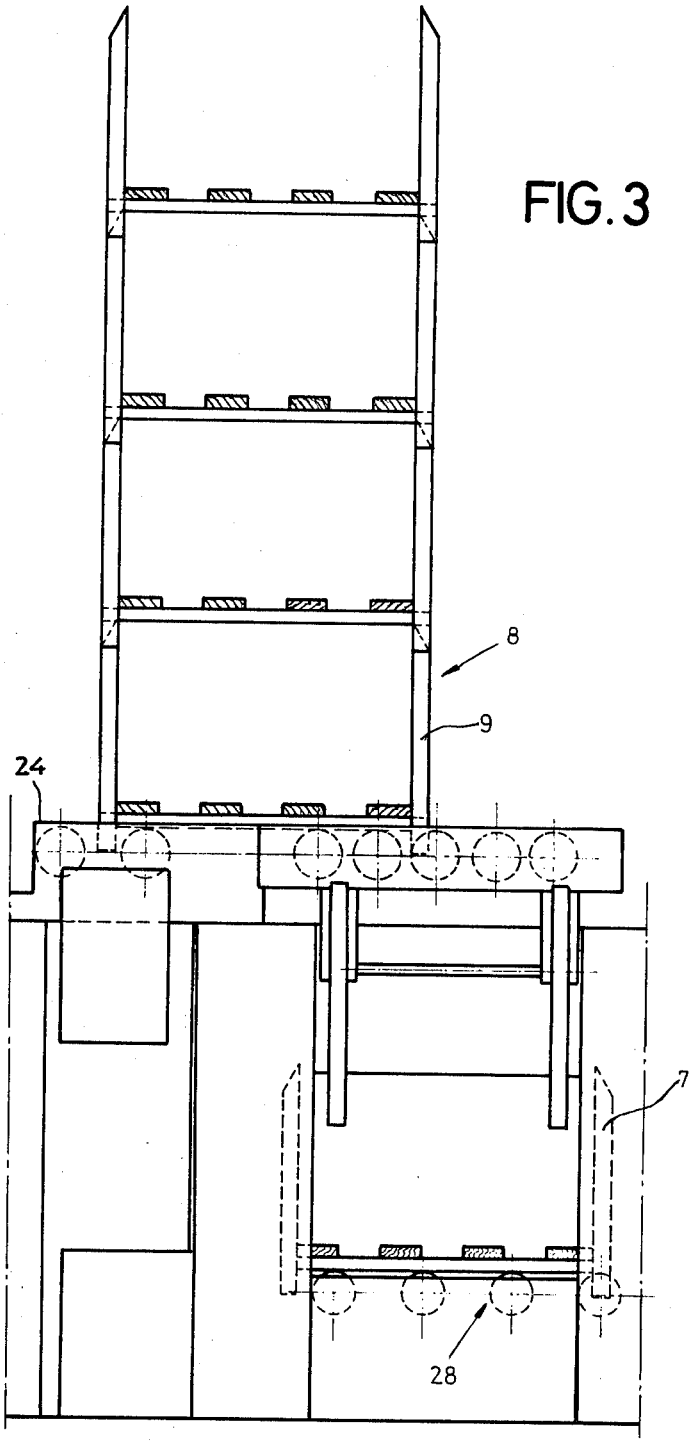
FIG. 3 is a side view of the conveyor for a stack of empty pallets and an unstacking station.
Figure 4:
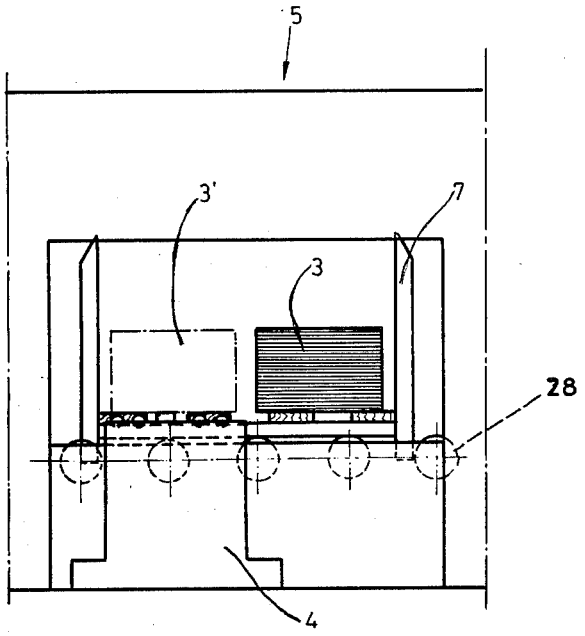
FIG. 4 is a side view of a pile loading station.
Figure 5:
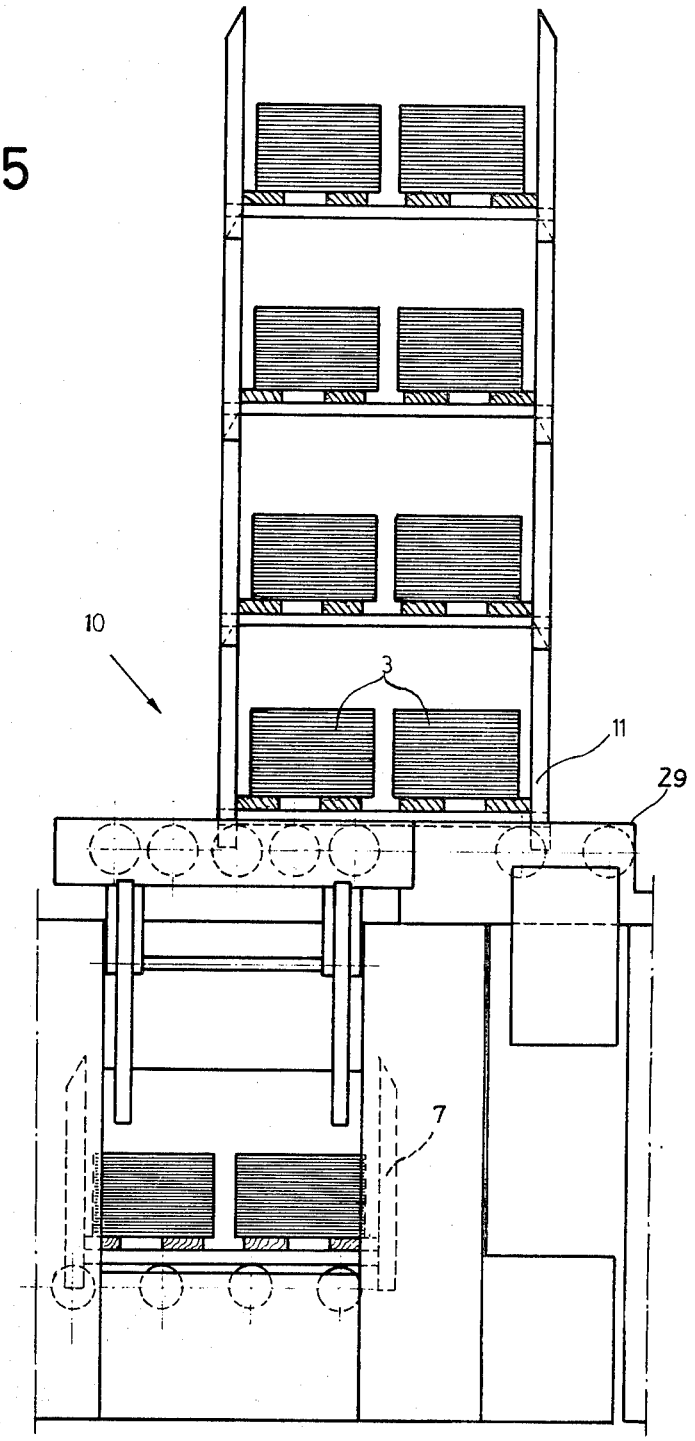
FIG. 5 is a side view of a stacking device for loaded pallets.

The palletizer 6 is shown in greater detail in FIGS. 2–6. As illustrated, the conveyor 24 is a track having the plurality of rollers extending thereacross for conveying a stack 9 of empty pallets. As illustrated in FIG. 2, each stack 9 is composed of four pallets. The track 24 extends into the second unstacking station 8 (FIG. 3) where the individual pallets 7 are removed from the stack 9 of unloaded or empty pallets and placed on a roller track 28, which is at an elevation lower than the track 24.

The track 28 carries the empty pallets 7 to the inlet 5 (FIG. 4) where the pallet is positioned relative to the conveyor 4 so that it can receive a first row of piles 3 of box blanks. After the first row has been received on the pallet, electrical contacts or switches will be actuated and the rollers or conveyor 28 will shift the pallet 7 a given distance to allow a second row of piles 3′ to be loaded onto the pallet.

Figure 6:
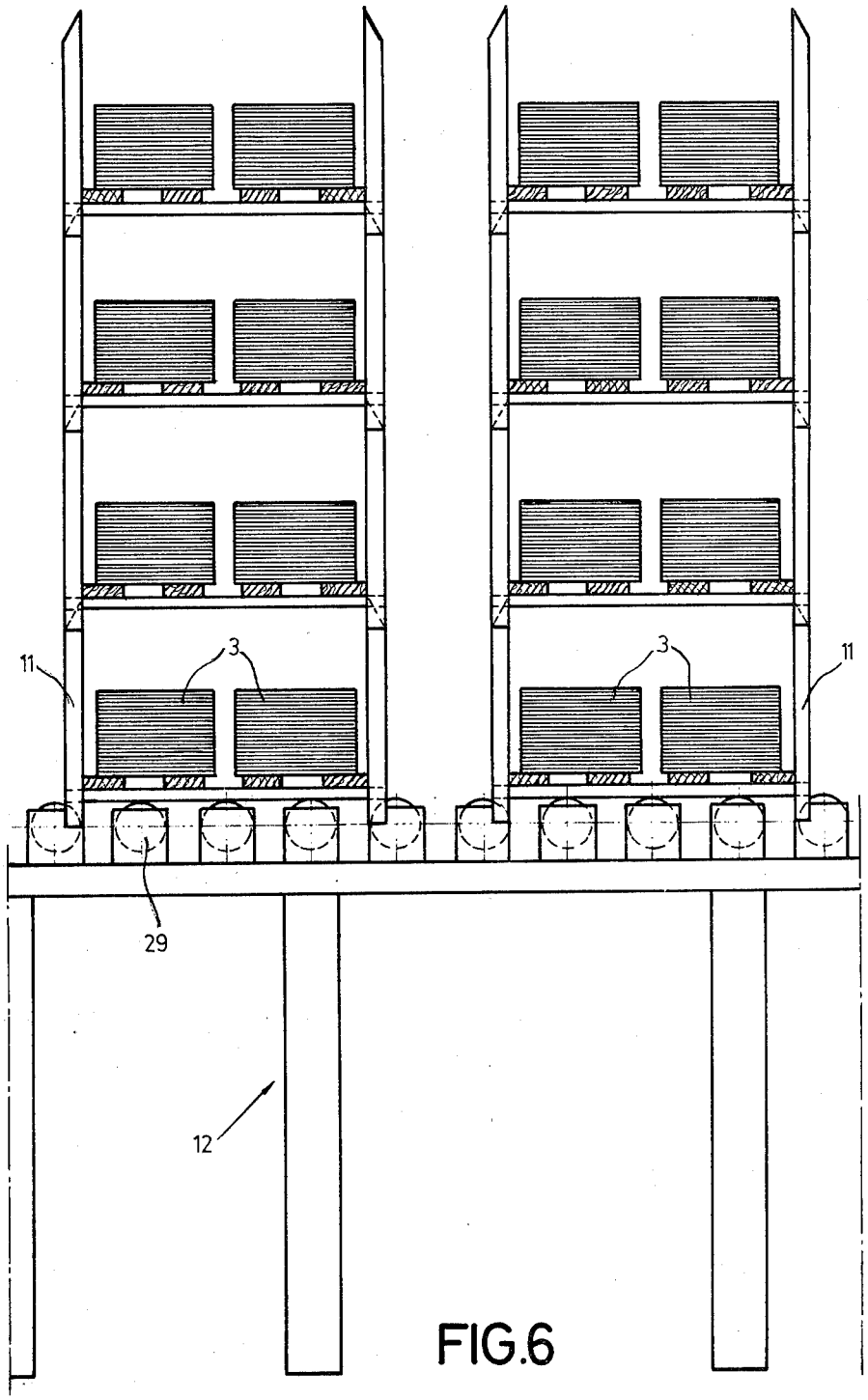
FIG. 6 is a side view of a conveyor for stacks of loaded pallets.

With the piles of box blanks illustrated by the rows 3 and 3′ disposed on the pallet 7, the roller track 28 conveys the loaded pallets 7 to the first stacking station 10 (FIG. 5) where the loaded pallet is joined with other loaded pallets to form a stack 11 of four loaded pallets. From the stacking station 10 the stacks 11 of loaded pallets are conveyed on a roller track 29 into the storage station 12 (FIG. 6). It should be noted that after a pallet 7 has been loaded at the inlet 5 (FIG. 4) and then transferred to the first stacking station 10 for full pallets another empty pallet will be received from the second unstacking station 8 and transferred to a position for receiving the piles 3. In the stacking station such as 10, the loaded pallet is joined with other loaded pallets to form the stack 11. In the particular embodiment, a total of four pallets are stacked together to form a stack 11 and the stacking of these pallets at the station 10 will be synchronized with the unstacking of the pallets at the station 9 and also with the loading of the piles of blanks at the inlet 5.

Figure 7:
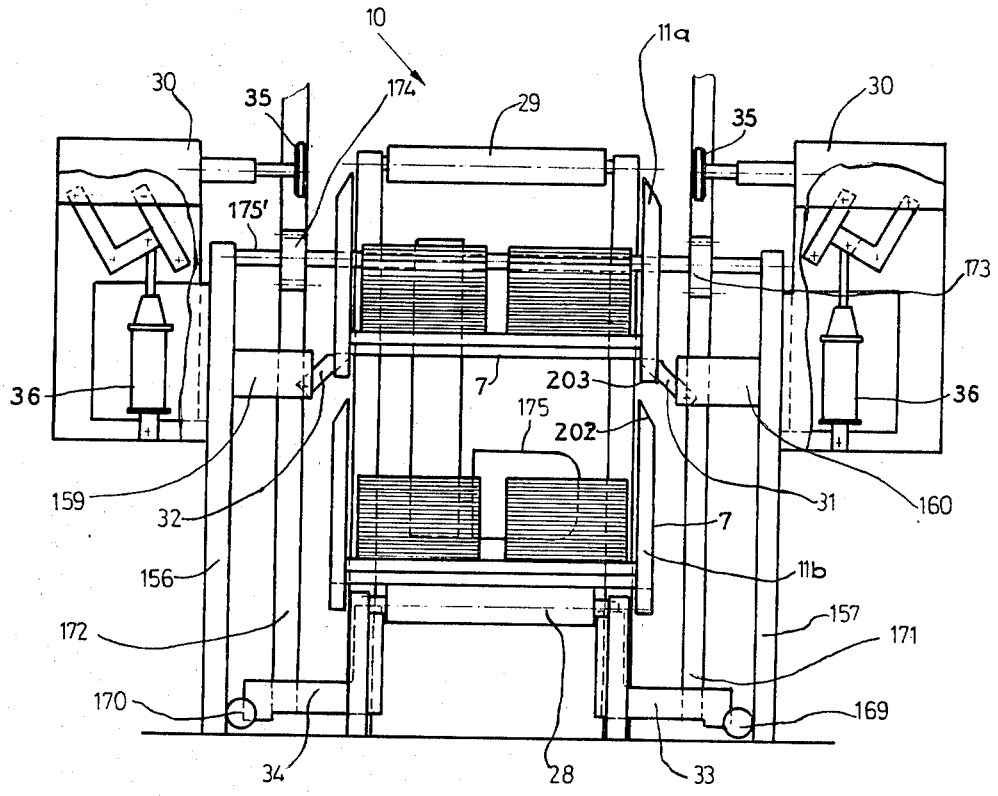
FIGS. 7–12 are detailed views showing successive operations during formation of a stack of pallets.
Figure 8:
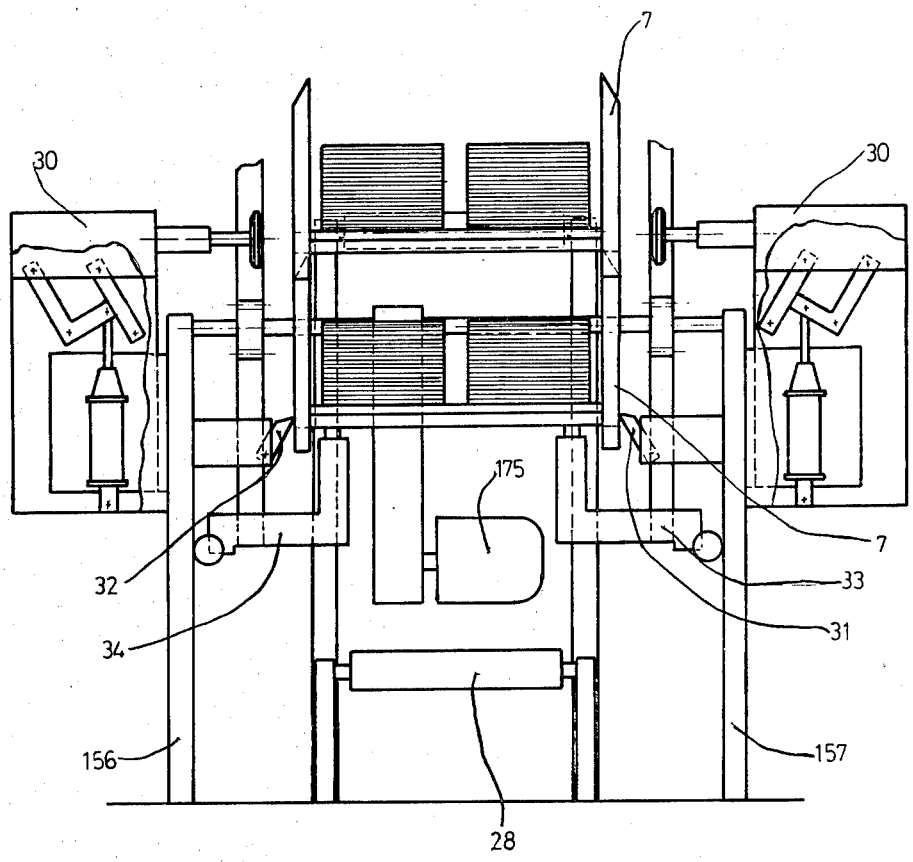
Figure 9:
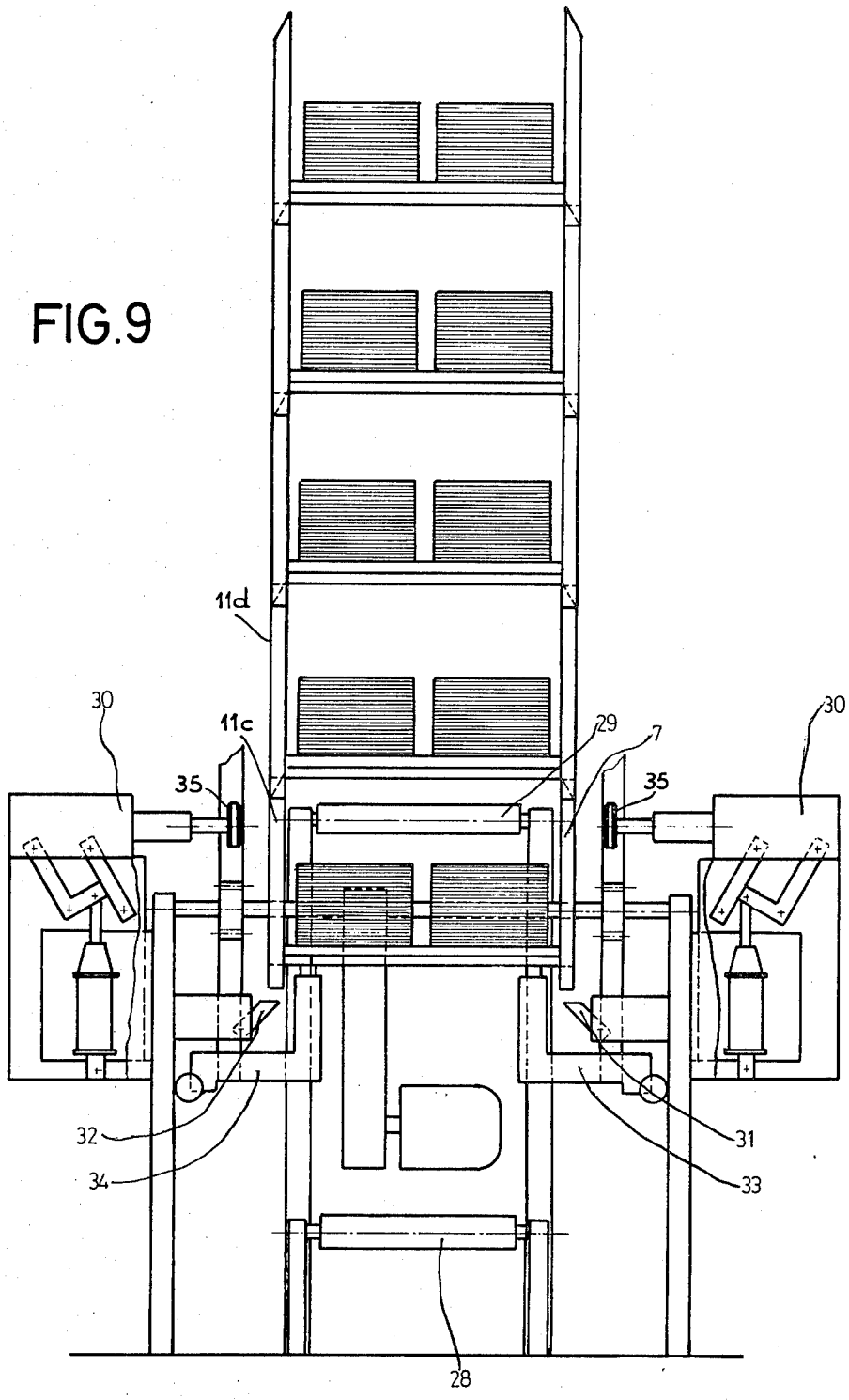
Figure 10:
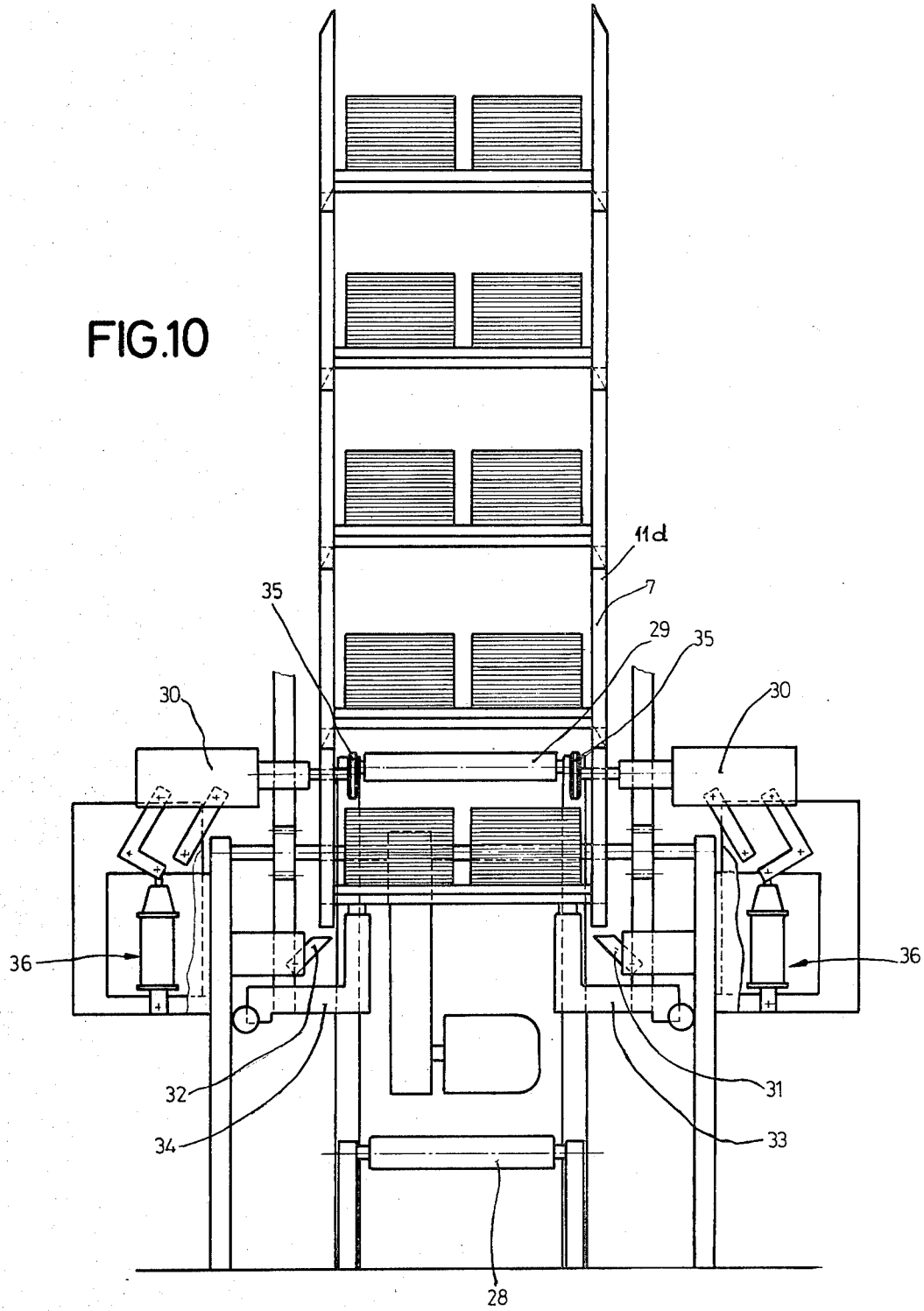
Figure 11:
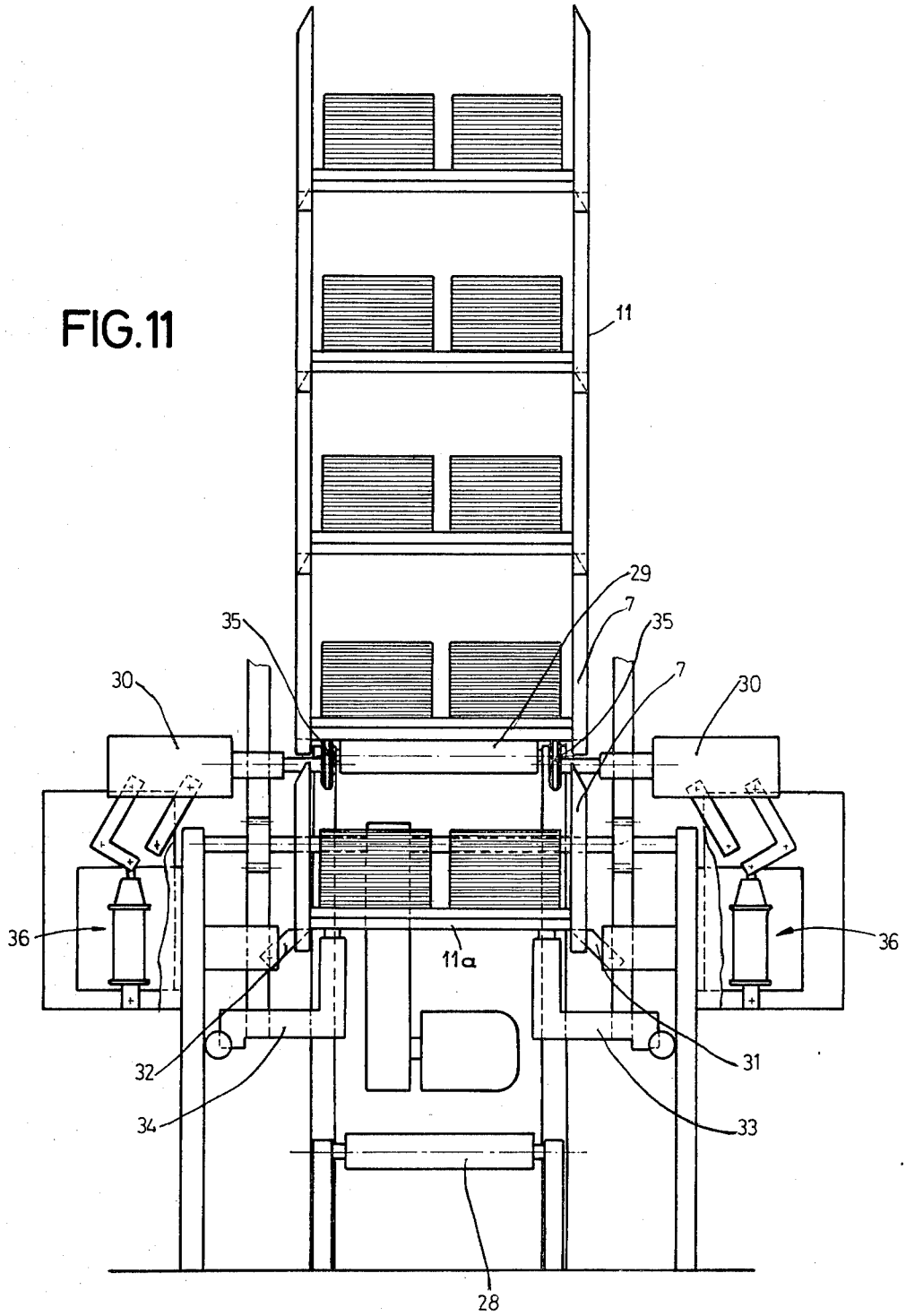
Figure 12:
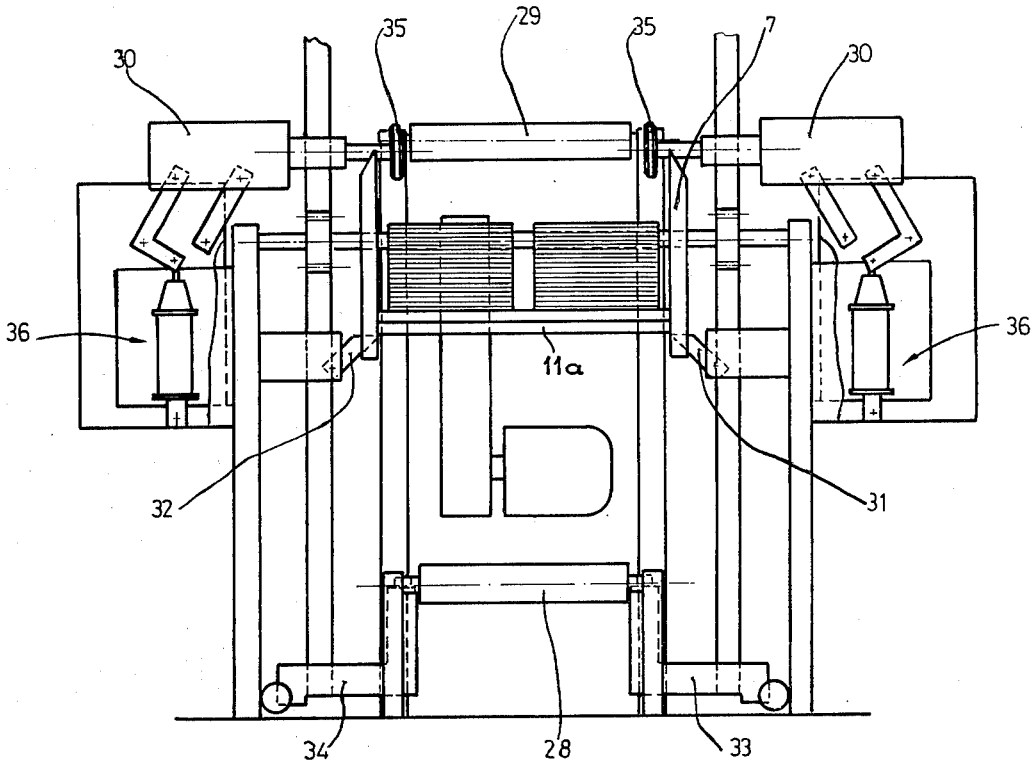

The structure of the means for forming a stack such as the first stacking station 10 is illustrated in FIGS. 7–12 which also illustrate the operation of the stacking means. The structure of the stacking means has a frame which includes frame elements 156 and 157 which are spaced apart and extend vertically a sufficient distance to enable operation of the stacking device. Supported on the frame elements 156 and 157 are a pair of movable conveyors 30 with roller 35 which are movable by controls 36 from a retracted position such as illustrated in FIG. 7 which has the roller 35 out of the path of the pallets to an extended position such as illustrated in FIGS. 10 and 11 to position the roller 35 to convey a stack 11 of loaded pallets onto the roller track 29. Extending from the frame members 156 and 157 are supported portions or members 159 and 160, respectively. Pivotably mounted in the support member 160 is a retainer or stop 31 and pivotably mounted in the support member 159 is a retainer or stop 32. Preferably, at least two stops are positioned on each side such as adjacent each corner of the pallet. As illustrated the retainers are pivotable from a retaining position illustrated in FIG. 7 for holding a pallet 7 in a position 11*a* to positions such as illustrated in FIG. 8, which allow the passage of a pallet thereby.

To lift the pallet from a position 11*b* to a position 11*a*, a lift mechanism with a pair of pushers 33 and 34 is provided. As illustrated, the pusher 33 has a guide roll 169 engaging the frame member 157, and the pusher 34 has a guide roll 170 engaging the frame member 156. In addition, the pushers 33 and 34 are provided with members 171 and 172, respectively, which have a rack gear disposed thereon which copperates with driven pinions 173 and 174, respectively, to elevate the pushers 33 and 34 from the position illustrated in FIG. 7 through the position such as illustrated in FIG. 9. To rotate the pinions 173 and 174, a motor 175 is coupled to an axle 175' which supports the pinions 174 and 175.

At the start of a stacking operation, a pallet 7, which is resting on the retainers 31 and 32, is held in a position 11*a* below the plane of the conveyor track 29 but above the conveyor track 28. An additional pallet 7 on the track 28 assumes a position 11*b* which is over the pushers 33 and 34. Due to actuation of the motor 175, the pushers 33 and 34 are moved upward to raise the pallet that was in the position 11*b* until its upper end 202 engages the pads 203 of the pallet 7 in the position 11*a* to lift the pallet in a position 11*a* from the retainers or stops 31 and 32. With continuous elevation (see FIG. 8), the pallet resting on the pushers 33 and 34 will engage the stops or retainers 31 and 32 and cam them to a retracted position to enable passage thereby. As the pallet reaches a position 11*c* in FIG. 9, which is the maximum height the lifters or pushers 33 and 34 can reach, the next adjacent pallet assumes a position 11*d* (FIG. 9) which is above the plane of the rollers 29 of the roller track as well as the rollers 35 of the conveyors 30. At this position, the stops or retainers 31 and 32 can move back to the extended position. Upon lowering of the pushers 33 and 34, the pallet in position 11*c* will move to the position 11*a* and be engaged on the stops as the pushers move down to their lowermost position illustrated in FIG. 7.

The above procedure is repeated until five loaded pallets are stacked together as illustrated in FIG. 9. At this time, the controls 36 are actuated to shift the conveyor means 30 to the extended position (FIG. 10) with rollers 35 disposed beneath the pallet which is in the position 11*d*. Then as the pushers 33 and 34 are moved to the lower position, the lowermost pallet 7 assumes a position 11a on the retainers 31 and 32 and the pallet which was in the position 11*d* is supported on the rollers 35 of the conveying means 30, which moves the stack 11 onto the track 29 to be conveyed into the storage means 12. After conveying or moving the stack 11, the conveyors 30 are moved to the retracted position illustrated in FIG. 7 and the stacking means can repeat the operation by lifting a pallet moved in the position 11*b* (FIG. 7) to form a subsequent stack.

Figure 13:
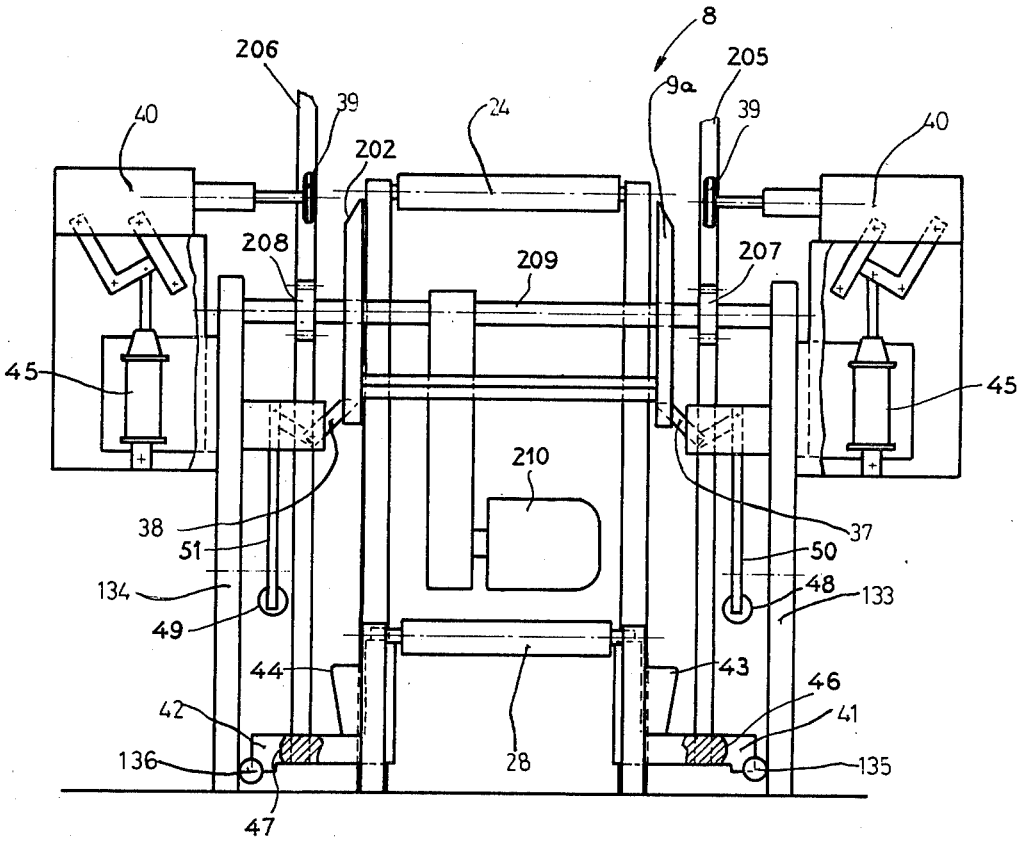
FIGS. 13–18 are detailed views of the operation of unstacking a stack of pallets.
Figure 14:
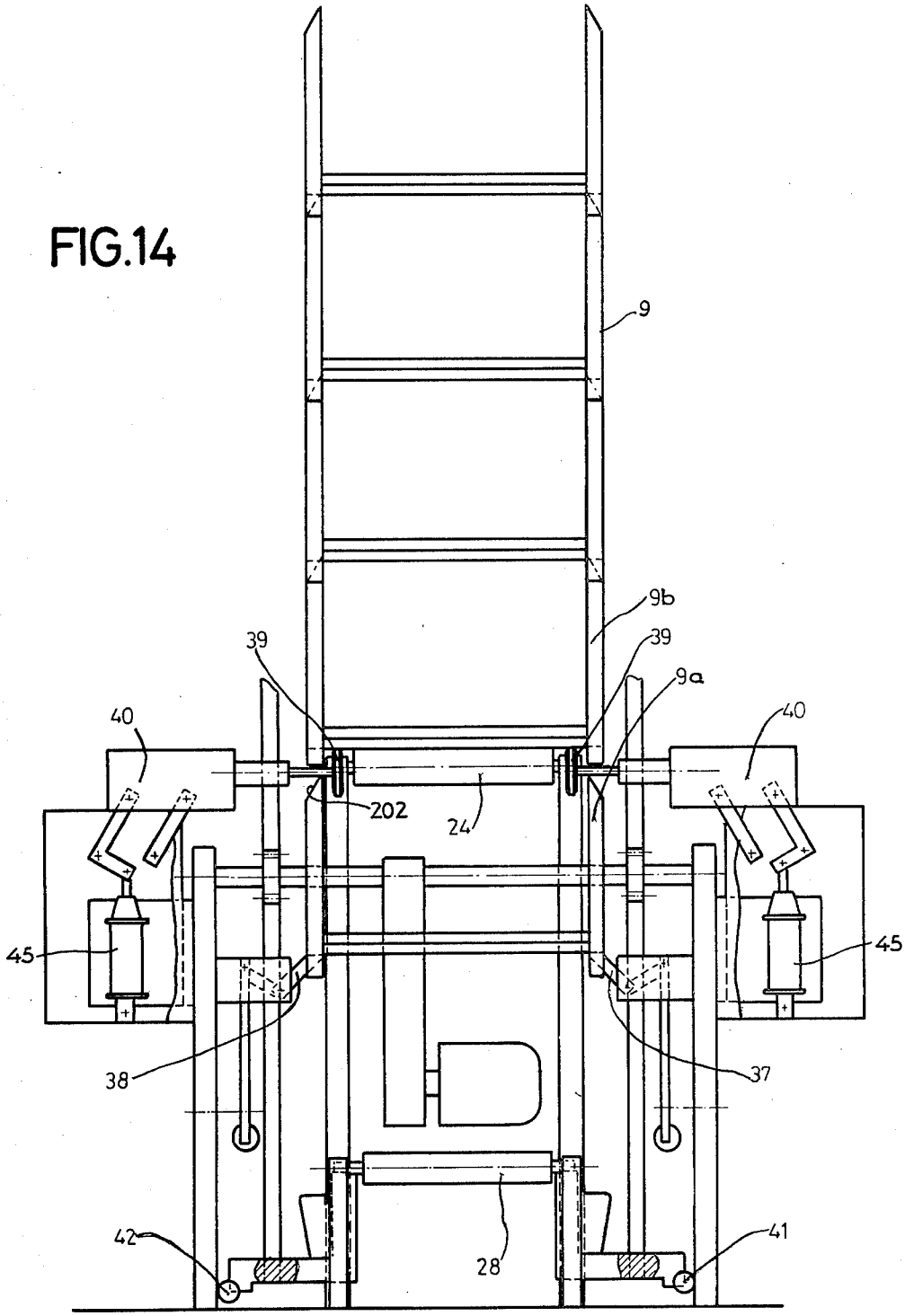
Figure 15:
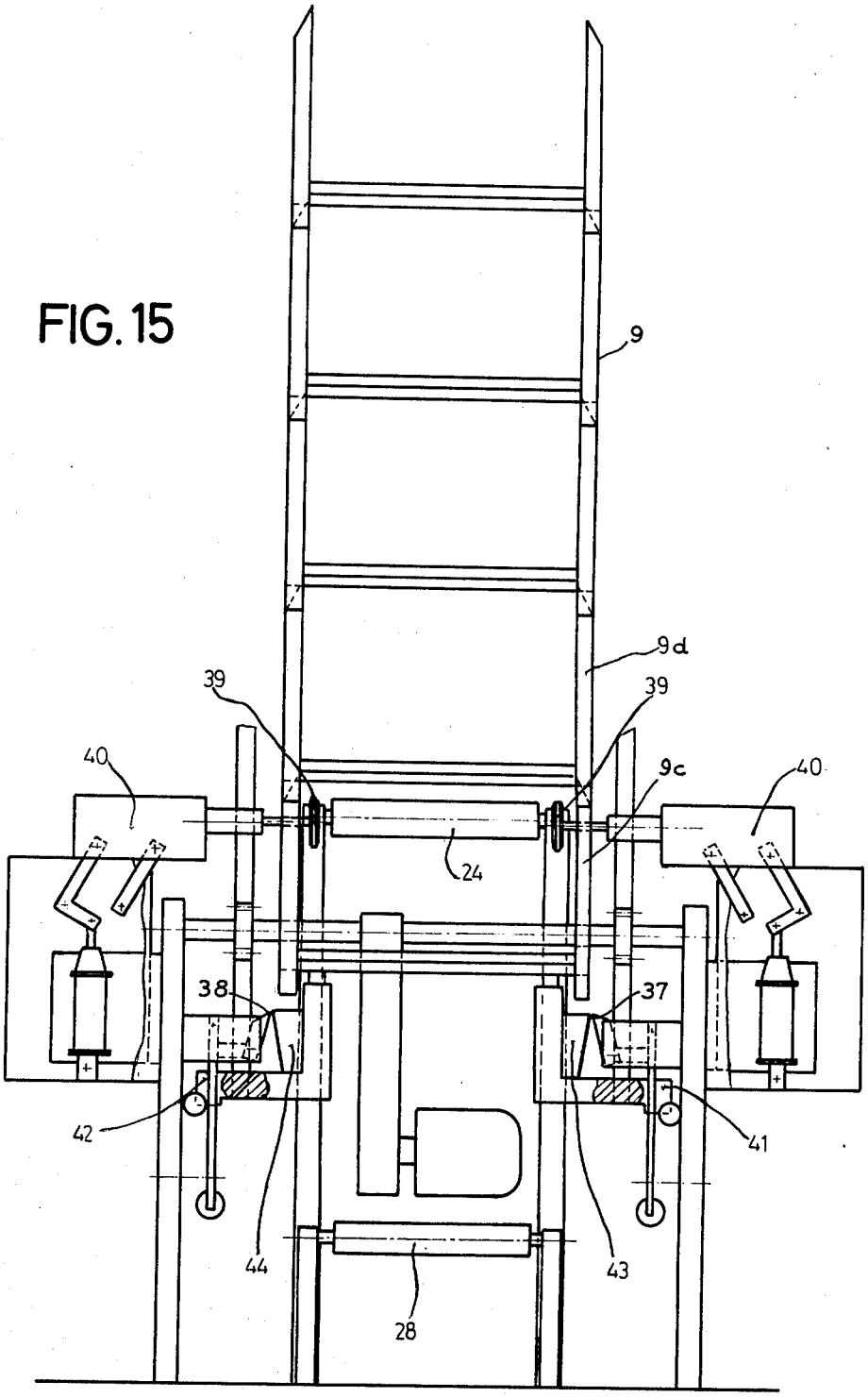

The structure of the second unstacking station 8 in which a pallet 7 is removed from a stack 9 of pallets is best illustrated in FIGS. 13–18 which show various sequential operations thereof. As illustrated in FIG. 13, the unstacking station 8 has a frame with a pair of side or lateral frame members 133, 134. Stops or retainers 37 and 38, which are pivotably mounted for movement from an extended position illustrated in FIG. 13 to retracted positions such as illustrated in FIG. 15, are disposed on extensions or members which are attached to the members 133 and 134. As in the previous stacking device, more than one stop 37 may be disposed on a side. Also supported on each of the frames 133 and 134 are conveyor means 40 having rollers 39 which are movable by a control 45 from a retracted position illustrated in FIG. 13 to an extended position illustrated in FIG. 14 by act of a control such as 45. A lifting mechanism, which includes pushers 41 and 42, which are provided with guide rollers 135 and 136 engage the frame portions 133 and 134, respectively, is provided. The lift mechanism is similar in many respects to the previous lift mechanism and is provided with members such as 205 and 206 which are provided with rack gears engaged by pinions 207 and 208, respectively, which are disposed on an axle 209 which is in driving engagement with a motor 210. Each of the pushers 41 and 42 is provided with a first set of cams 43 and 44, which will engage the pivotable stops 37 and 38, respectively, to move the stops to a retracted position. Each of the stops 37 and 38 has means for holding it in a retracted position which includes a lever arm 50 and 51, respectively, which support followers 48 and 49. In addition to the cams 43 and 44, each of the pushers 41 and 42 has a cam surface 46 and 47, respectively, for engaging the followers 48 and 49.

Figure 16:
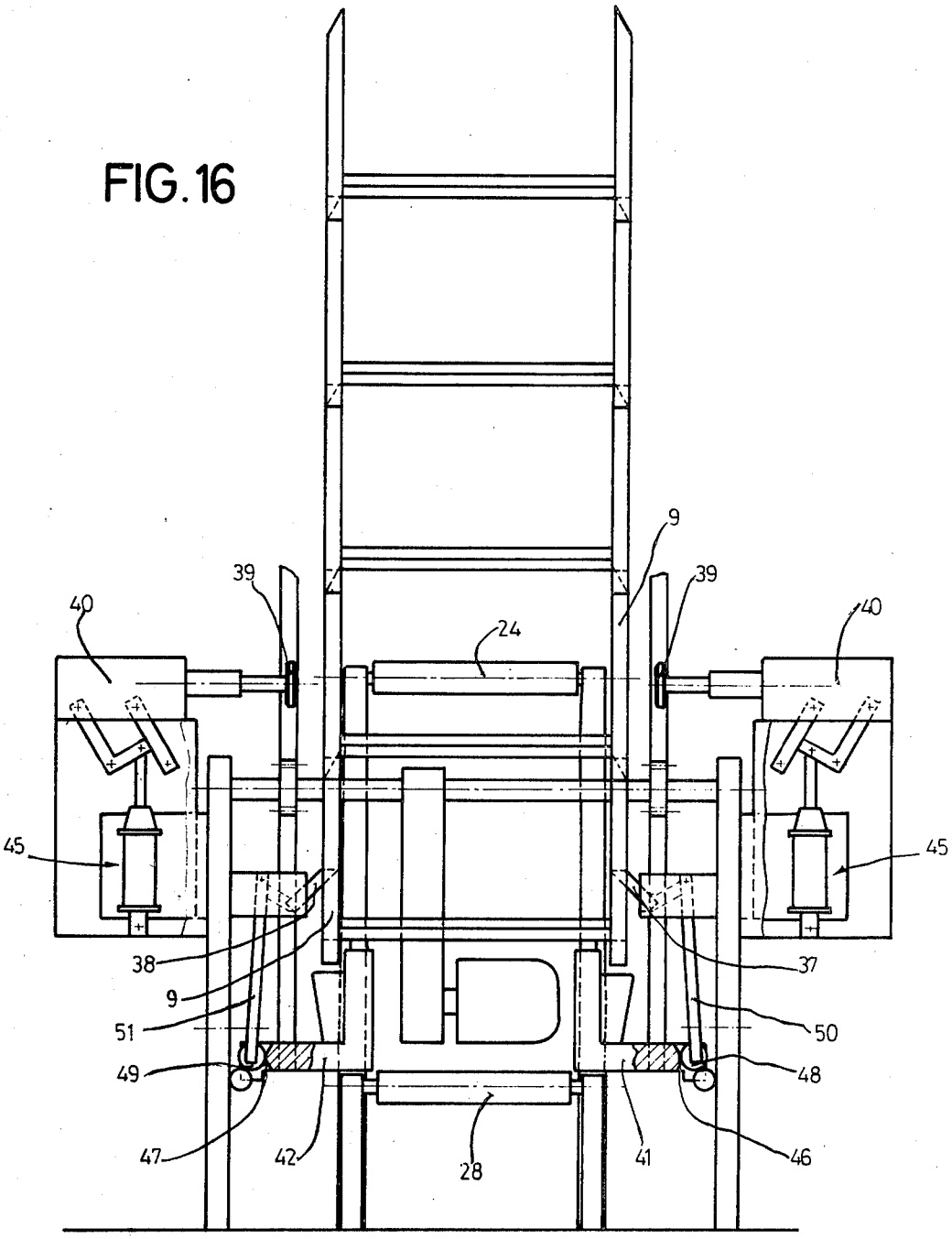
Figure 17:
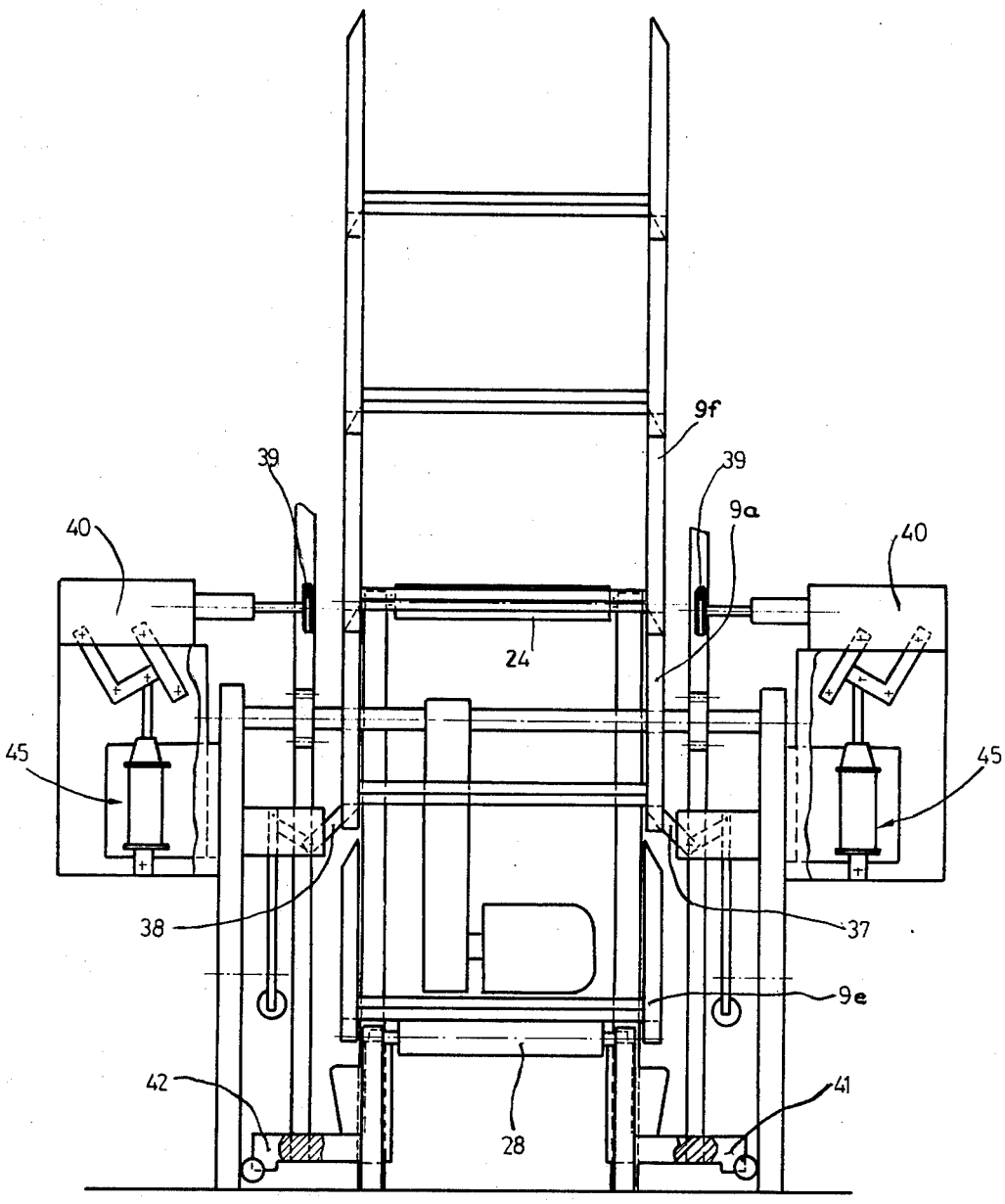
Figure 18:
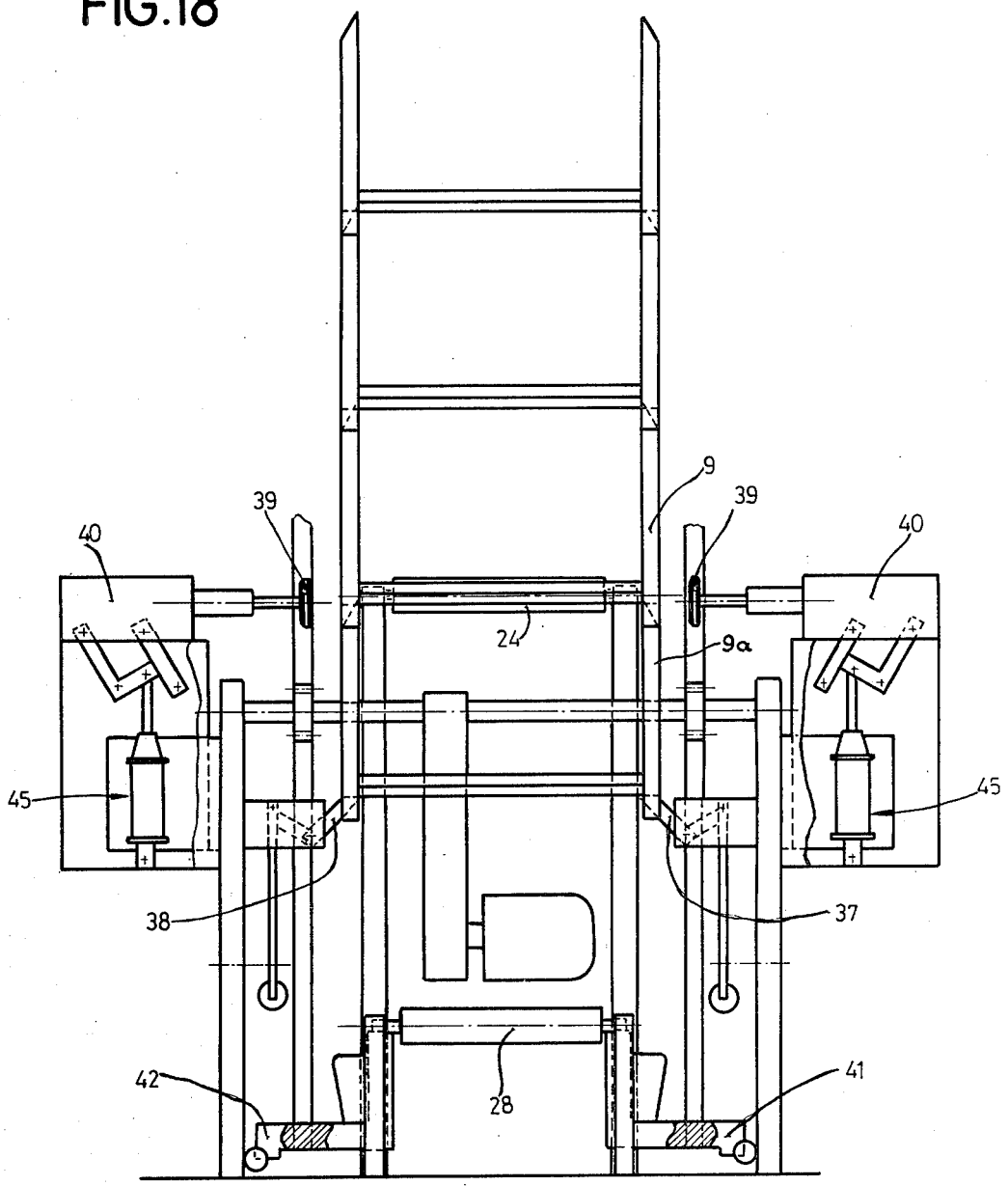

Operation of this unstacking device or means 8 is as follows. With a pallet 7 in a position 9*a* resting on the stops 37 and 38, the upper ends 202 of the pallet are beneath the plane defined by the rolls of the roller track 24 as well as the rollers 39, 39 of the conveyor means of the station. The conveyor means 40 are moved by the action of the controls 45, 45, which are pneumatic cylinders to the extended position (FIG. 14) so that a stack 9 of unloaded pallets can be moved and positioned over the pallet 9*a* which is resting on the stops 37 and 38. In this position, the lowermost pallet of the stack 9 is in a position 9*b* (FIG. 14). While in this position, the lift mechanism is raised by action of the motor 210 to an elevated position until the pushers 41 and 42 engage the bottom of the pallet in the position 9*a* and continue to raise until cams 43 and 44 engage the stops 37 and 38 and move them to the retracted position (FIG. 15). This will occur when the pallet resting on the pushers 43 and 44 assumes the position 9*c* which moves the lowermost pallet of the stack 9 to a position 9*d* which is out of engagement with the rollers 39 of the conveyor means 40 so that the conveyor means can be shifted to a retracted position (FIG. 16). After the conveyor means 40 have been moved to a retracted position to move the rollers 39 and 39 out of the way of the stack 9, the lift mechanism of the pushers 41 and 42 can be lowered and due to the holding means, the stops 37 and 38 allow passage of the pallet resting on the lift mechanism. As the lift mechanism approaches the position illustrated in FIG. 16, the cams 46 and 47 contact the rollers or followers 48 and 49 to pivot the arms or levers 50 and 51 to release the holding mechanism for the stops or retainers 37 and 38 so that they may be shifted or biased back to the extended position as illustrated. With continual lowering of the pushers 41 and 42 to the position illustrated in FIG. 17, the previous lowest pallet of the five pallets will assume position 9*e* on the track 28 for conveyance out of the unstacking mechanism. The retainers 37 and 38 hold the next lowest pallet at a position 9*a* and the third lowest pallet is in a position 9*f*, which as illustrated is below the plane of the conveyors such as rollers 39, 39. While in the position shown in FIG. 17, actuation of the conveyors 28 will remove the pallet in position 9*e* and the cycle is initiated again to lower the pallet in position 9*a* eventually to the position 9*e* for removal from the stack.

Figure 19:
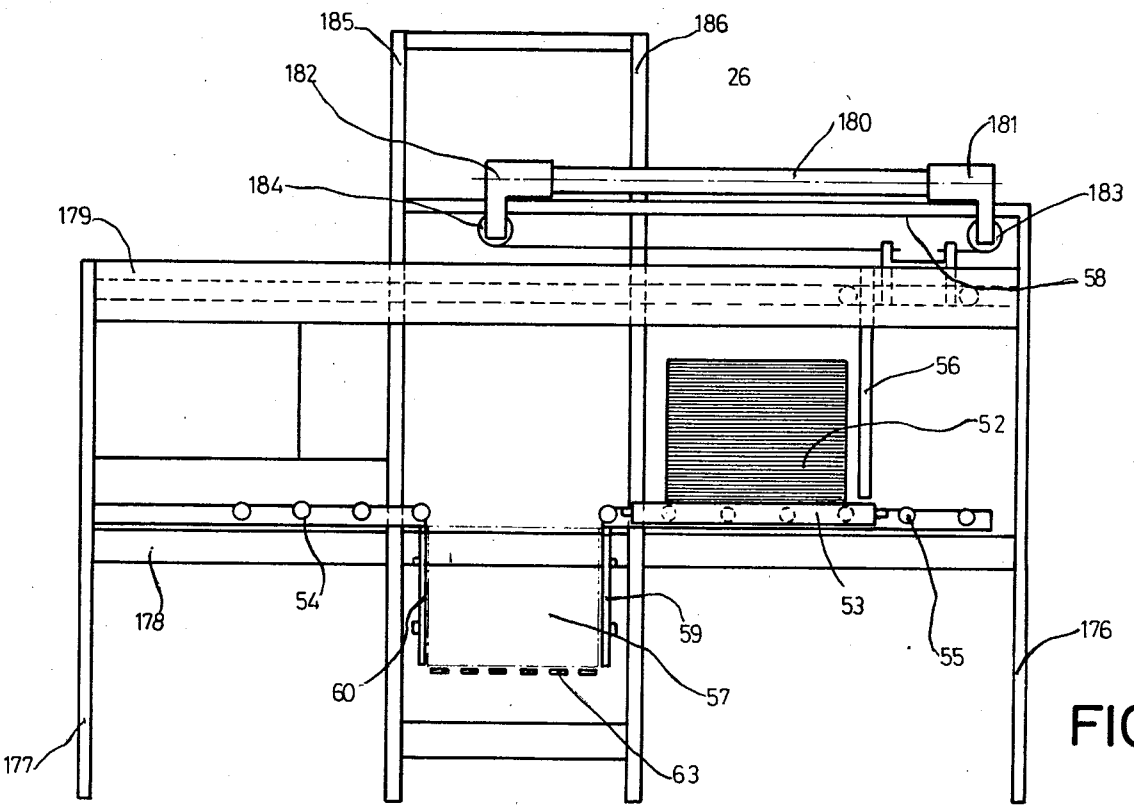
FIGS. 19–22 are side views of a device for transporting the piles of box blanks from the pile unloading device to the receiving station of a box folding and gluing machine.
Figure 20:
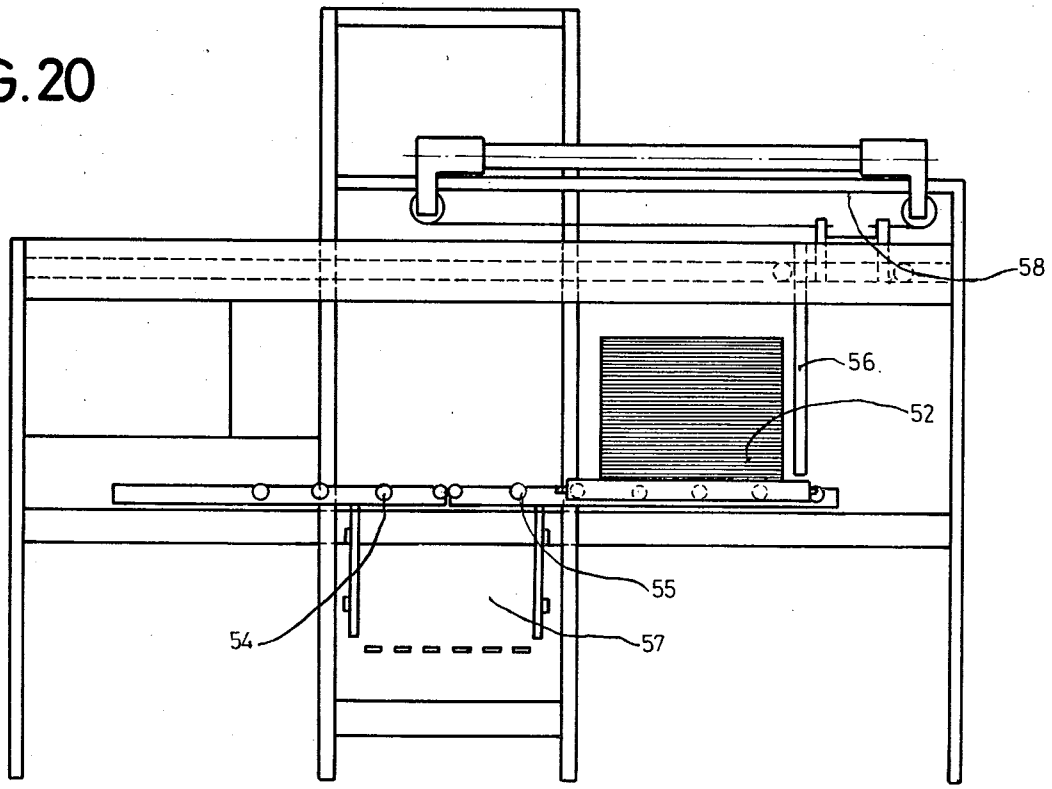
Figure 21:
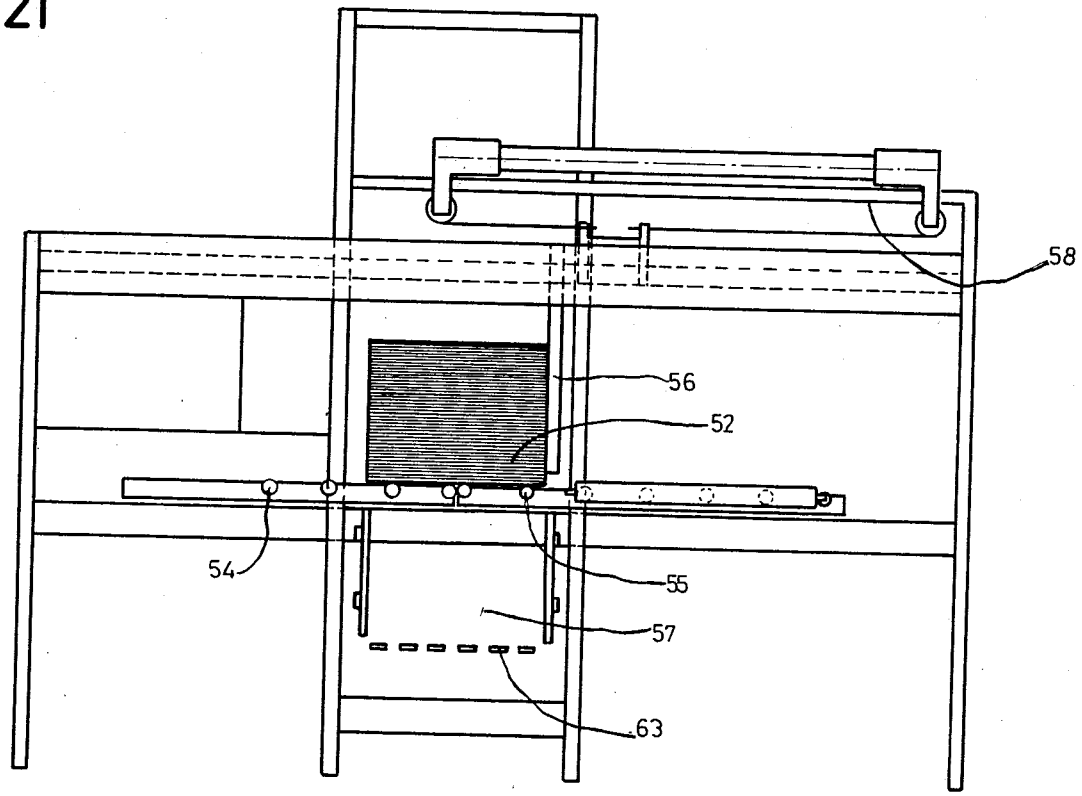
Figure 22:
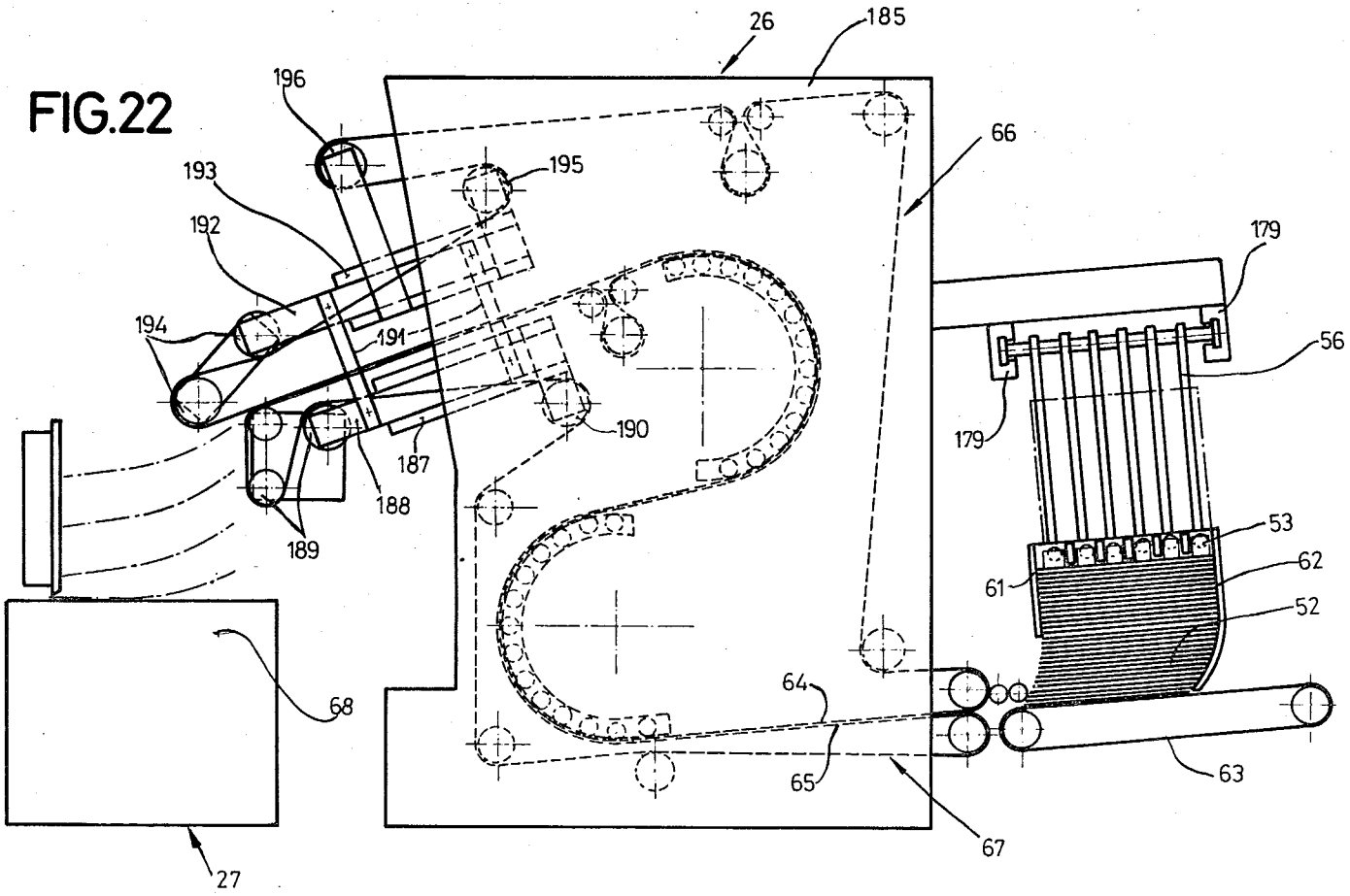

The transfer of a pile of blanks such as 3 from the conveyor 22 into the preparatory station 26 which is the receiving station for the folding and gluing means 27 is best illustrated in FIGS. 19–22. The device 26 includes a frame comprising upstanding frame members 176, 177 which are interconnected by lower frame members 178 and upper frame members 179. In addition, side members 185 and 186, which support conveyor means 66 and 67 are part of the frame. A pile of box blanks such as 52 is deposited from the transfer device onto a conveyor 53. At this stage, movable conveyors 54 and 55 are in a retracted position and a pusher assembly 56, which is located to the right of the pile 52 in FIG. 19 is also in a retracted position. In the next phase of the transfer, the conveyors 54 and 55 are moved to the extended position (FIG. 20) so that the empty space above an inlet or hopper 57 of the preparatory station 26 is blocked. In the third phase, the pile of box blanks will be moved above the inlet 57 onto the movable conveyors 54 and 55 by the pusher 56 which is actuated by a cable drive 58. Finally, in the fourth stage, the conveyors 54 and 55 are retracted to a position illustrated in FIG. 19 so that the pile 52 will drop into the inlet or hopper 57 and onto a conveyor 63. The hopper 57, as best illustrated in FIGS. 19 and 22, is defined by the lateral guides 59 and 60 (FIG. 19) and the other guides 61 and 62 (FIG. 22) so that the pile 52 is positioned between the guides when it is dropped into the hopper 57. The guides 61 and 62 (FIG. 22) each have the same height although the rear guide 62 has a curved portion adjacent the belt of the conveyor 63 to cause the blanks to be shifted in preparation for their subsequent feeding into the preparatory station for the box folding and gluing machine 27. Preparatory station 26 consists of a conveyor belt 63 which extends beneath the receiving station or hopper 57 for the pile 52 and conveys the blanks between belts 64 and 65 of two preparatory conveyors 66 and 67, which are supported between frame members 185 and 186. The conveyors 66 and 67 have the purpose of individually detaching the blanks from a shingled stream and at the outlet of the preparatory conveyors the boxes will be supplied onto a feeder 68 of the box folding and gluing machine 27 within which they will be folded and subsequently glued before being batched by a conventional packing station.

In order to move the stops or pusher device 56, the cable drive 58 has a carriage which is guided in grooves disposed in the cross bars or structural members 179 (FIG. 22). The cable drive 58 has a support 180 equipped with two end pieces 181 and 182 in which two pulleys 183 and 184, respectively, are mounted for rotation. The pulley 183 is driven by a motor which is not illustrated so that the carriage of the cable drive 58 will be translated from the position illustrated in FIG. 19 to shift the pusher 56 to the position illustrated in FIG. 21.

To compensate for changes in the size of the box blank being transported, the two preparatory conveyors 66 and 67 each have a section at the discharge end which is adjustable so that the position of the discharge from the feeder can be changed. For the conveyor 67 this adjustable section includes a slide rail 187 in which a sliding shoe 188 is guided. The shoe 188 is equipped with pulleys 189 located at one of its ends and with pulley 190 disposed at an opposite end. This arrangement allows for a modification of the position of the pulleys 189 without influencing the length of the belt 65. The sliding shoe 188 is connected by braces 191 to a sliding shoe 192 of the conveyor 66. By utilizing the braces 191 the sliding shoe 192 shifts within the sliding rail 193 and its pulleys 194, 195 and 196 will also be shifted simultaneously with the shifting of the pulleys 189 and 190. Thus, by shifting the position of the slides 188 and 192, the conveyors 66 and 67 can compensate for a change in the width of the box blanks being handled.

Figure 23:
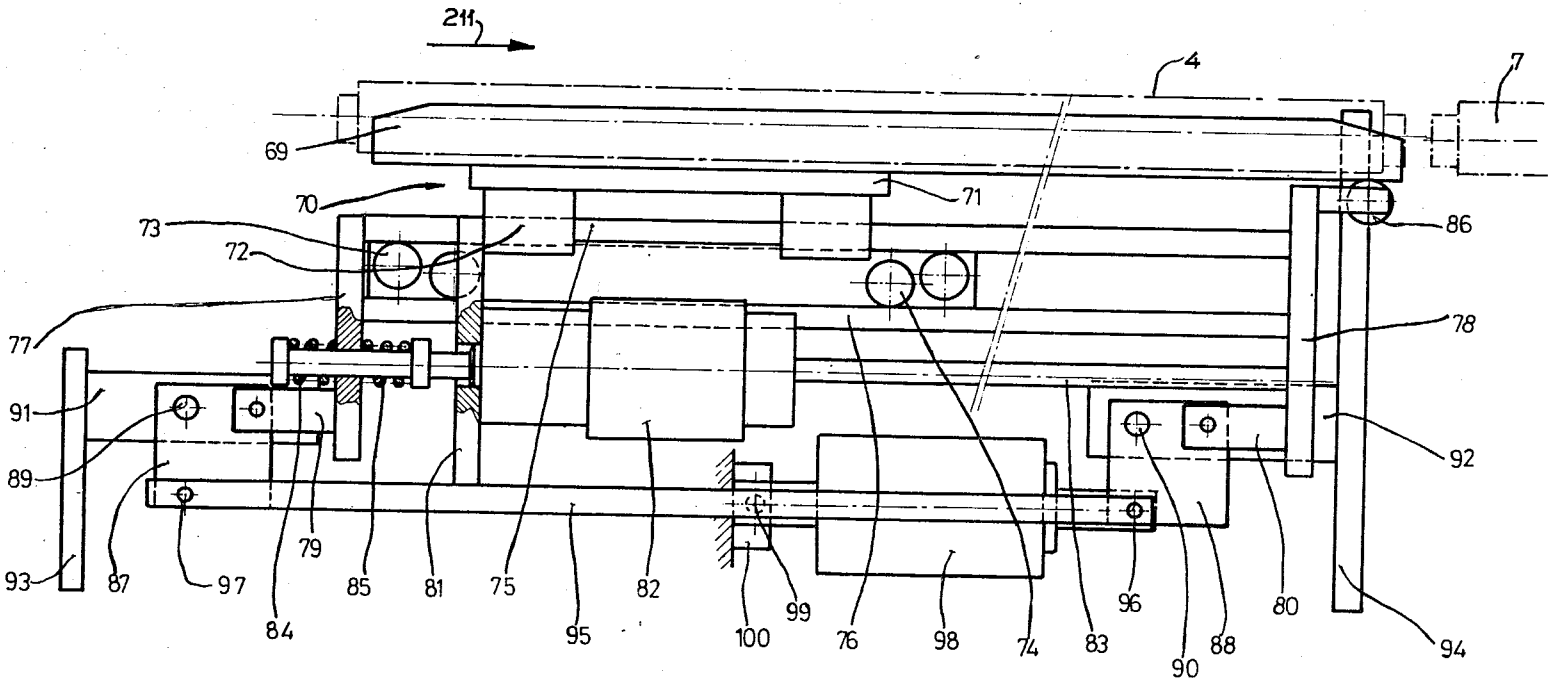
FIGS. 23 and 24 are detailed side views of a pile loading and unloading device of the present invention.
Figure 24:
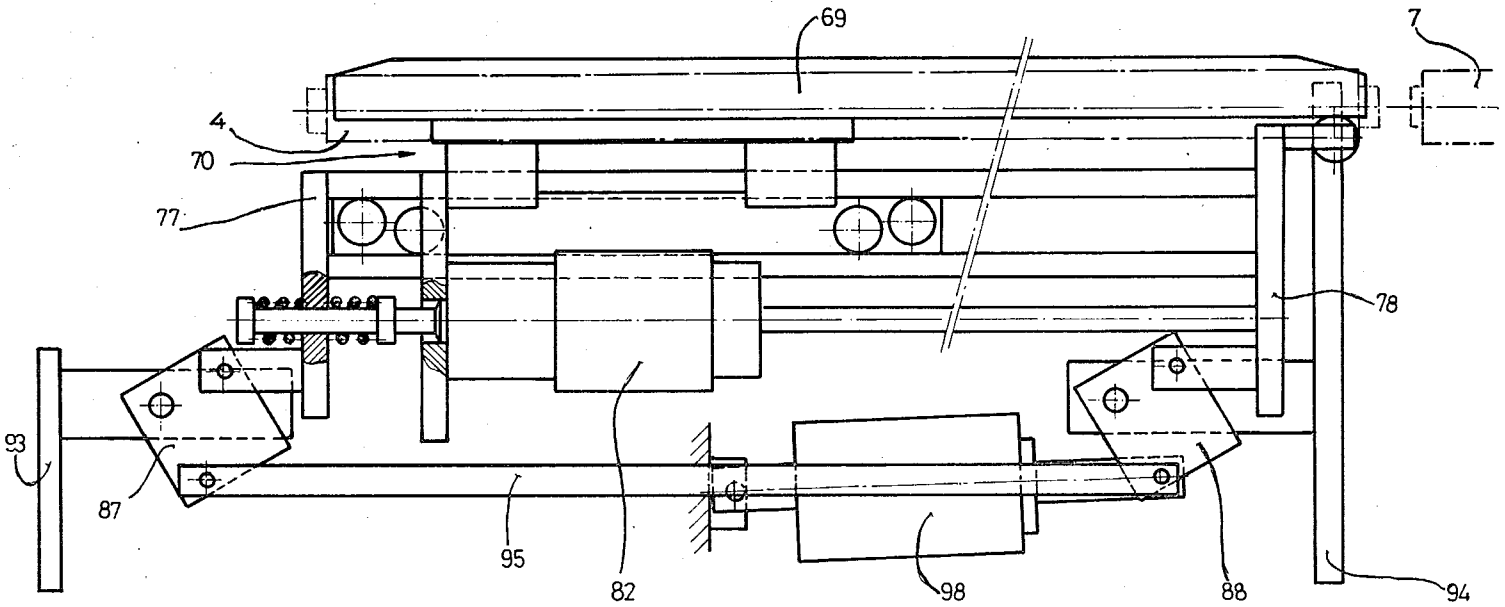

In order to load the piles 3 on the pallets 7 at the inlet or loading station 5 and to unload the piles from the pallet and onto the conveyor 22, a loading or unloading device illustrated in FIGS. 23 and 24 in relation to the rollers of the conveyor 4 and to a pallet in the station 5 is utilized. The loading device has a pair of forks 69, which are secured adjacent one end on a cradle 170 that consists of a base plate 71 which is secured to a carriage 72. The carriage 72 is provided with upper rollers 73 and lower rollers 74 with the upper rollers 73 guiding on a lower surface of the guide rails 75 and the lower rollers 74 guiding on upper face of a guiding rail 76. The guide rails 75 and 76 extend between sub-frame members 77 and 78 which are provided with braces 79 and 80, respectively. The carriage 72 also has a driving plate 81, which is secured to a linear motor 82 that acts and moves along a sliding rail 83, which consists of a round rod which is held against the side member or sub-frame member 77 by springs 84 and 85. Actuation of the linear motor 82 in one direction (arrow 211) will cause the shifting of the forks 69 whose free ends are supported on rollers 86 which are secured on the sub-frame member 78. The main frame of the device includes a pair of lateral frame members 93 and 94 which are provided respectively with brace portions 91 and 92. Brace portion 91 is pivotably connected at 89 to a lever 87 which is also pivotably connected to the brace 79 of the sub-frame member 77. In a similar manner, the brace 92 of the frame member 94 is pivotably connected at 90 to a lever 88, which is also pivotably connected to the brace 80 of the sub-frame member 78. The levers 87 and 88 are interconnected by a connecting rod 95, which is connected to the lever 88 by a pivot point 96 and the lever 87 by a pivot point 97. To rotate the levers about their respective pivot points 89 and 90, a pneumatic cylinder 98 is connected at the point 96 to lever 88 and is pivotably connected at 99 to a plate or member 100 of the main frame, which is rigidly secured relative to the frame member such as 93 and 94. Thus, when the cylinder 98 is actuated, the levers 87 and 88 are pivoted about their pivot points (see FIG. 24) to raise the level of the top surface of the forks 69 above the rollers of both the conveyor 4 and also above the surface of the pallet 7. Actuation of the linear motor in direction 211 enables piles carried on the forks 69 to be moved to a position where they can be deposited on a pallet 7 while in an elevated position. Then the cylinder is actuated to lower the forks so that the piles are placed on the surface of the pallet and the motor 82 is energized in the opposite direction to retract the forks to the position illustrated in FIG. 23.

Figure 25:
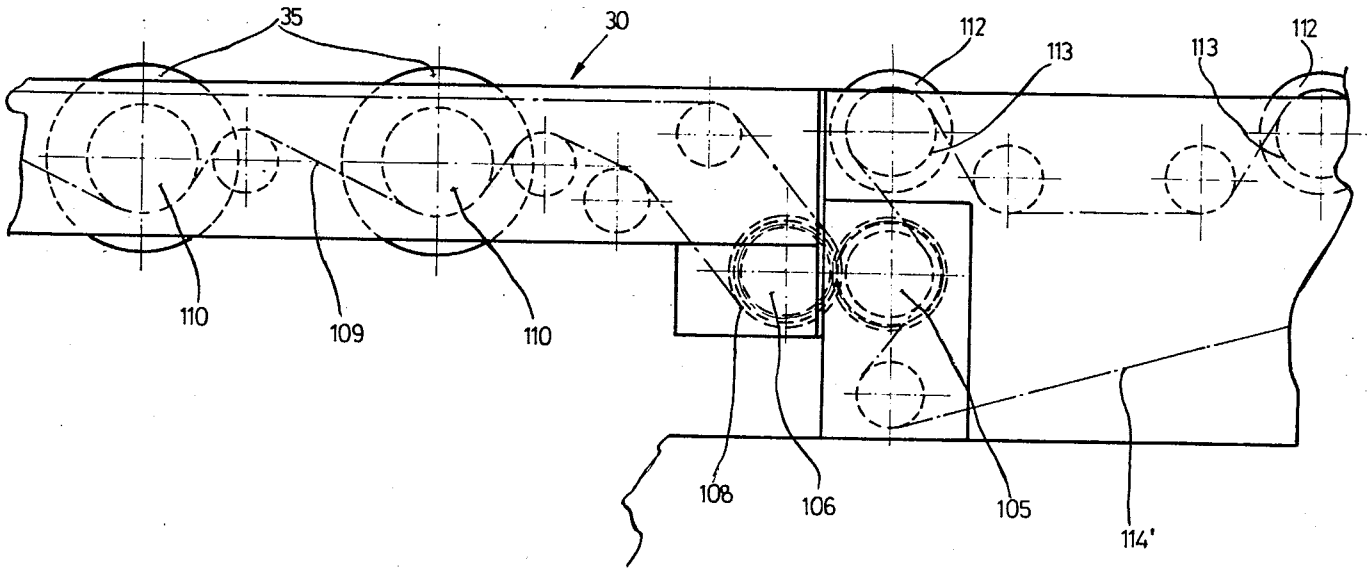
FIG. 25 is a side view of a pallet conveyor or roller in accordance with the present invention.
Figure 26:
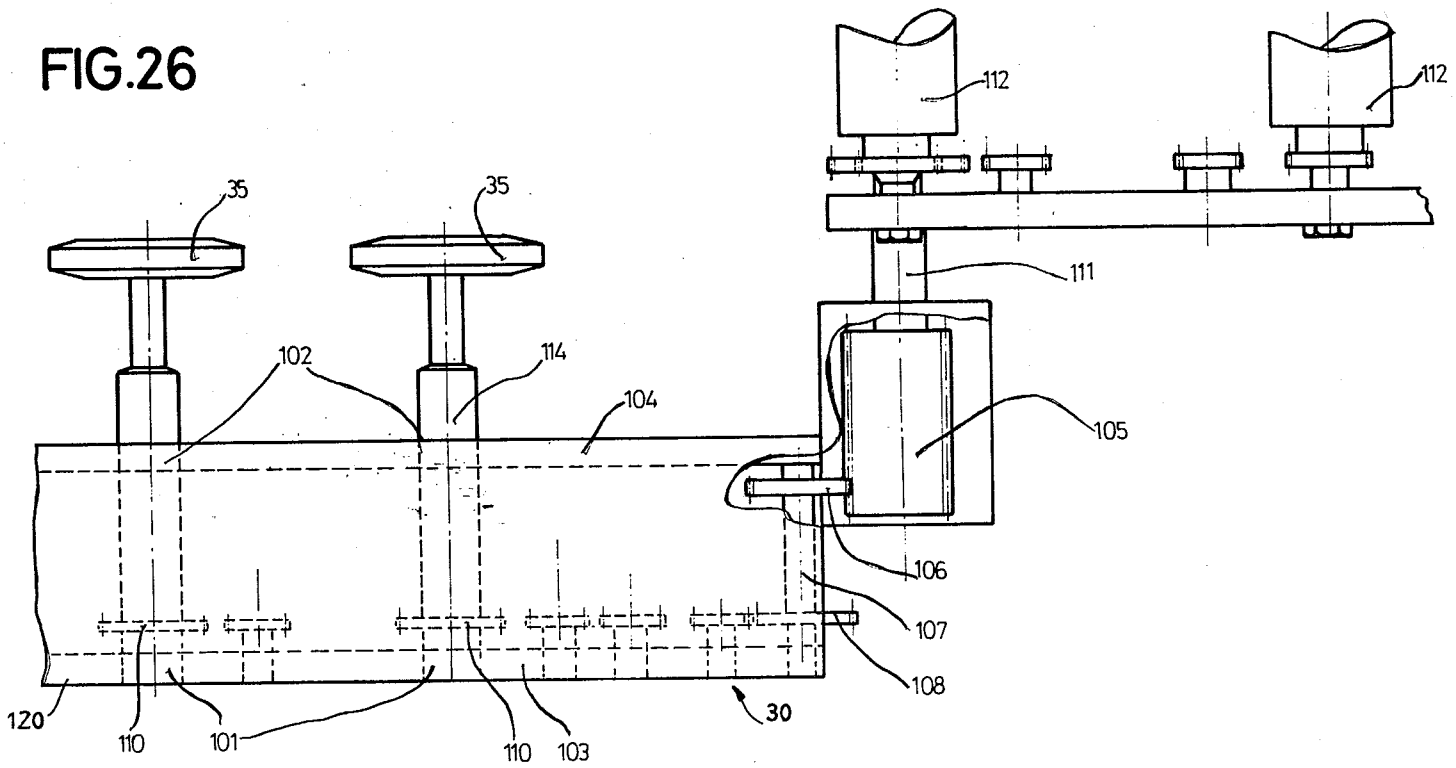
FIG. 26 is a plan view of the pallet conveyor or roller of FIG. 25.
Figure 27:
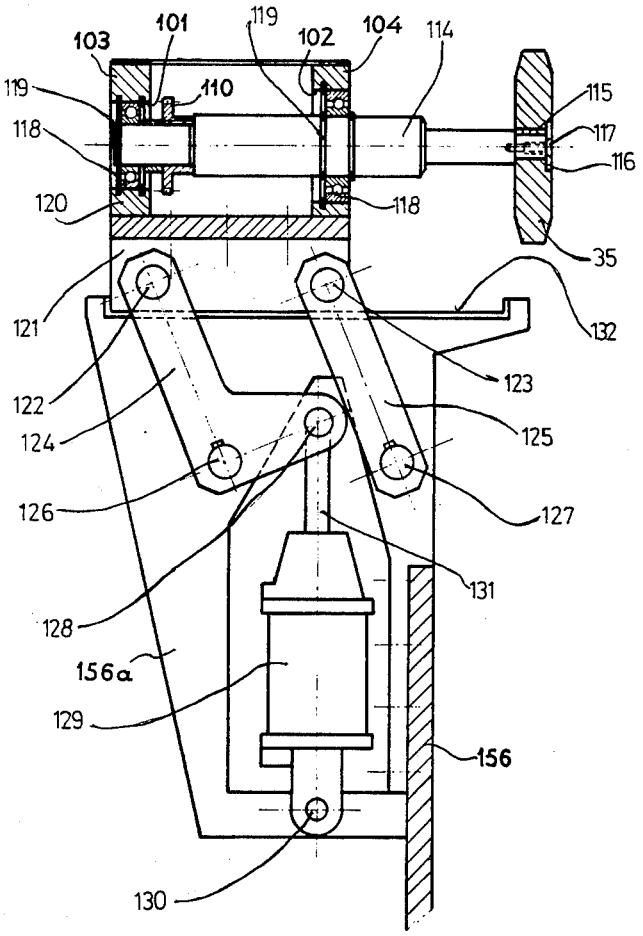
FIGS. 27 and 28 are cross-sectional views of the drive system for the pallet conveyor or roller illustrated in FIGS. 25 and 26.
Figure 28:
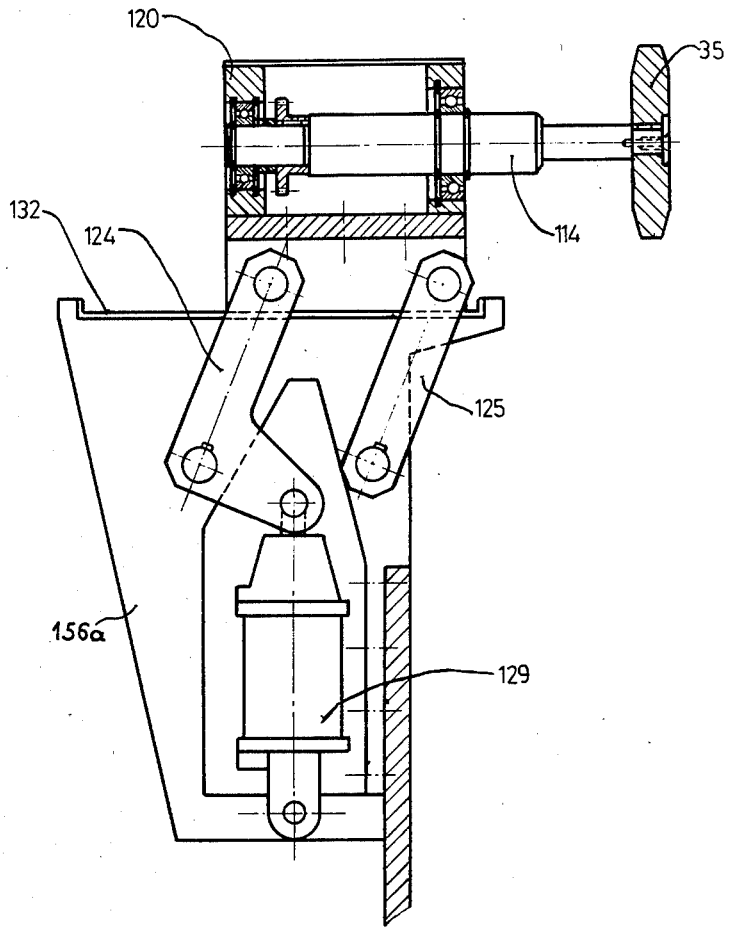

As mentioned before, the stacking means (FIGS. 7–12) has a conveyor means 30 and the unstacking device or means (FIGS. 13–18) has a conveyor device or means 40. The relationship and construction of the conveyor means or device for either the stacking or the unstacking stations is shown in greater detail in FIGS. 25–28. As illustrated in FIG. 27, each of the conveyor means 30 includes a frame 120 which has two longitudinal supports 103 and 104 which have aligned bores 101 and 102, respectively. To support an axle 114 the bores 101 and 102 receive roller bearings 118 which are held in position by snap rings 119. The roller 35 is secured on the end of the axle for rotation therewith by a key 115 and a disc 116 which is secured by a screw 117. Each of the shafts 114 is provided with a sprocket gear 110 which is in driving connection with a sprocket gear 108 by a chain 109 (FIG. 25). The sprocket gear 108 is secured on a shaft 107, which has a gear 106 meshing with a gear 105 which is secured on a shaft 111. The shaft 111 has a sprocket gear which is linked by a chain 114' to sprocket gears 113 by a chain 114' of a conveyor having roller 112. Thus, the rollers 35 of the conveying means 30 of the stacking station are driven synchronously with the rollers 112 regardless of whether they are in retracted or extended position.

As mentioned previously, the conveyor means 30 can be shifted from a retracted position such as illustrated in FIG. 7 to an extended position such as illustrated in FIG. 10. To accomplish this, the housing 120 has an extension 121, which is pivotably connected to a lever 124 by a pivot connection 122 and to a lever 125 by a pivot connection 123. The lever 124 is connected by a pivot connection 126 to an extension or plate **156*a* of frame member 156 of the stacking station. In a similar manner, the lever 125 is connected by a pivot connection 124 to the extension or member 156*a*. The lever 124 has a right angle portion to form a crank arm which is pivotably connected by pivot connection 128 to a piston rod 131 of an air piston 129 which, in turn, has its cylinder pivotably connected at 130 to the member 156*a*. The air piston is part of the control 36 illustrated in FIG. 7. The plate or extension 156*a* has a slide 132 for guiding movement of the extension 121. Thus, when the air piston 129 is actuated to retract the piston arm 131 from the position illustrated in FIG. 27 to the position illustrated in FIG. 28, the housing 120 of the conveyor means 30 is shifted along the track 132 from a retracted position illustrated to the extended position illustrated in FIG. 28**.

It should be noted that the conveyor means 40 and its control means 45 for the unstacking station illustrated in FIGS. 13–18 is of the same structure.

Figure 29:
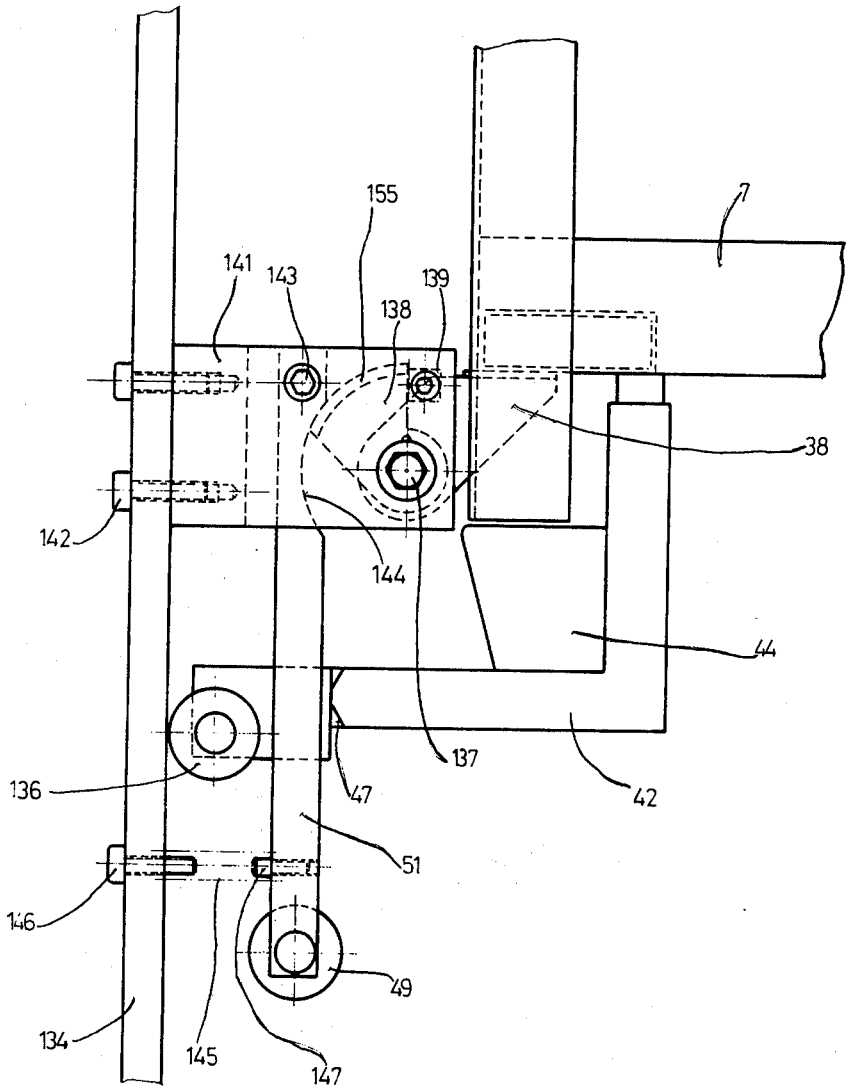
FIGS. 29–31 are detailed views of a retaining device for an unstacking station in accordance with the present invention.
Figure 32:
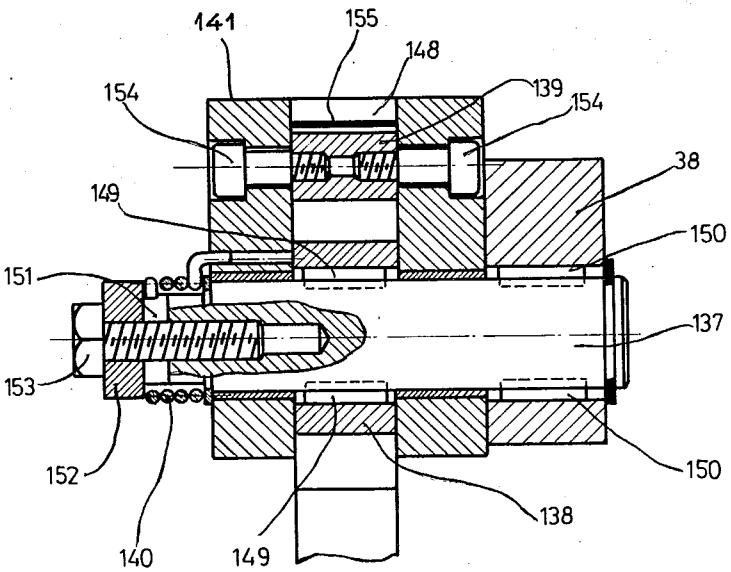
FIG. 32 is a cross-sectional view taken along lines A—A of FIG. 31.

In the discussion of the unstacking station such as 8 with regard to FIGS. 13–18, it was mentioned that the stops or retainers 37 and 38 had means for holding them in a retracted position. The retainer 38 is illustrated in greater detail in FIGS. 29–32. As illustrated, the retainer 38 is keyed by keys 150 (FIG. 32) to an axle 137 which is mounted for rotation in a bifurcated portion 148 of a structural member 141 which is secured on the frame member 134 by screws such as 142 (FIG. 29). As illustrated in FIG. 32, the member 141 is a U-shaped or fork-shaped member having two arms which receive a segment 138 therebetween which segment is keyed by keys 149 on the shaft 137. To provide a bias force to rotate the axle and the retainer or stop 38 towards a stop 139 a spring 140 is disposed on the axle or shaft 137 with a portion received or engaged in a part of the member 141 and a second portion held in a slot 151 in the shaft by a nut or pressure washer 152 held by a screw 153. The spring 140 urges the stop 38 and segment 138 to rotate with the axle in a clockwise direction as illustrated in FIG. 29 until the segment 138 engages the stop 139 (FIG. 32) which is held in the bifurcated portion of the member 141 by screws such as 154.

In addition to the stop 39 and segment 138, the bifurcated portion of the member 141 also pivotably mounts an end of the arm or lever 51, which is held by screws such as 143 (FIG. 29). The arm 51 has a curved segment portion or recess 144, which corresponds to the configuration of the segment member 138. Preferably, the segment member 138 is provided with a layer of friction material such as a brake lining 155 to increase the friction therebetween.

Figure 30:
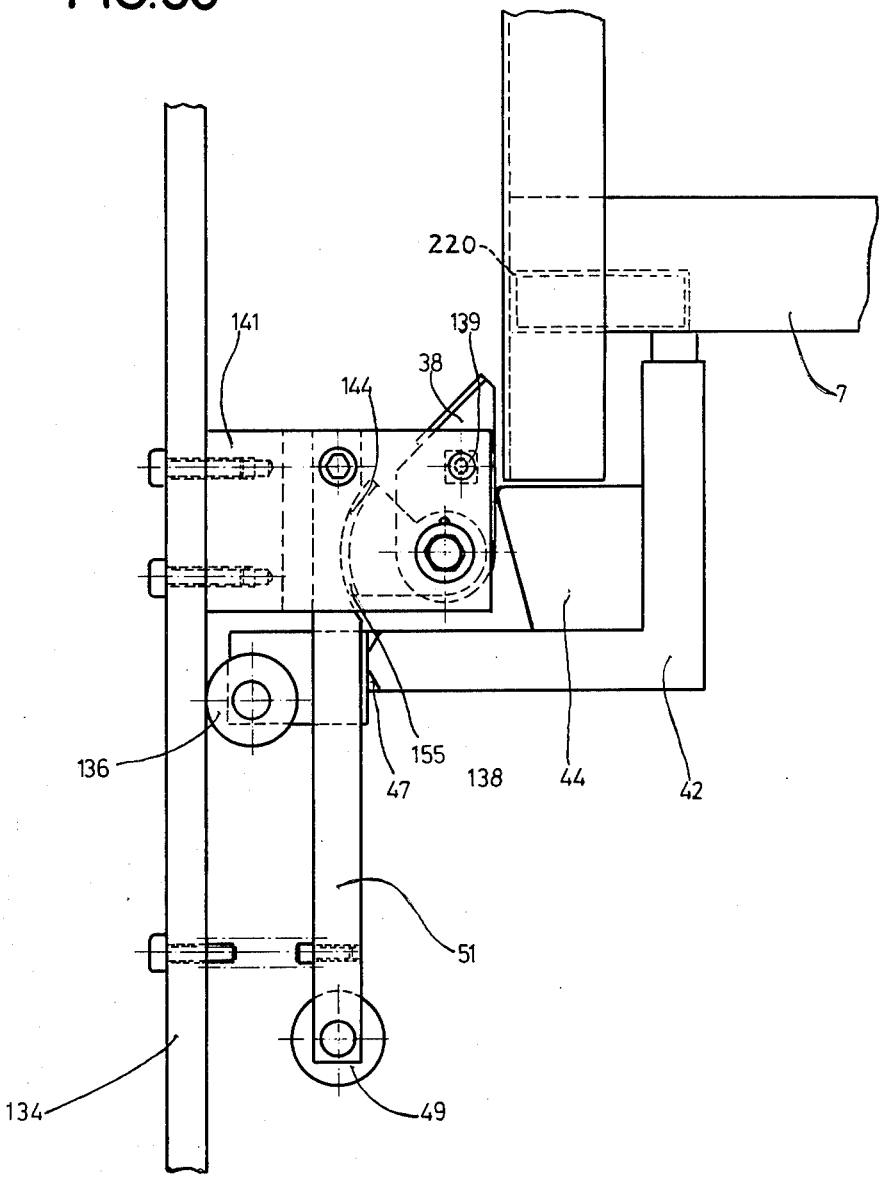
Figure 31:
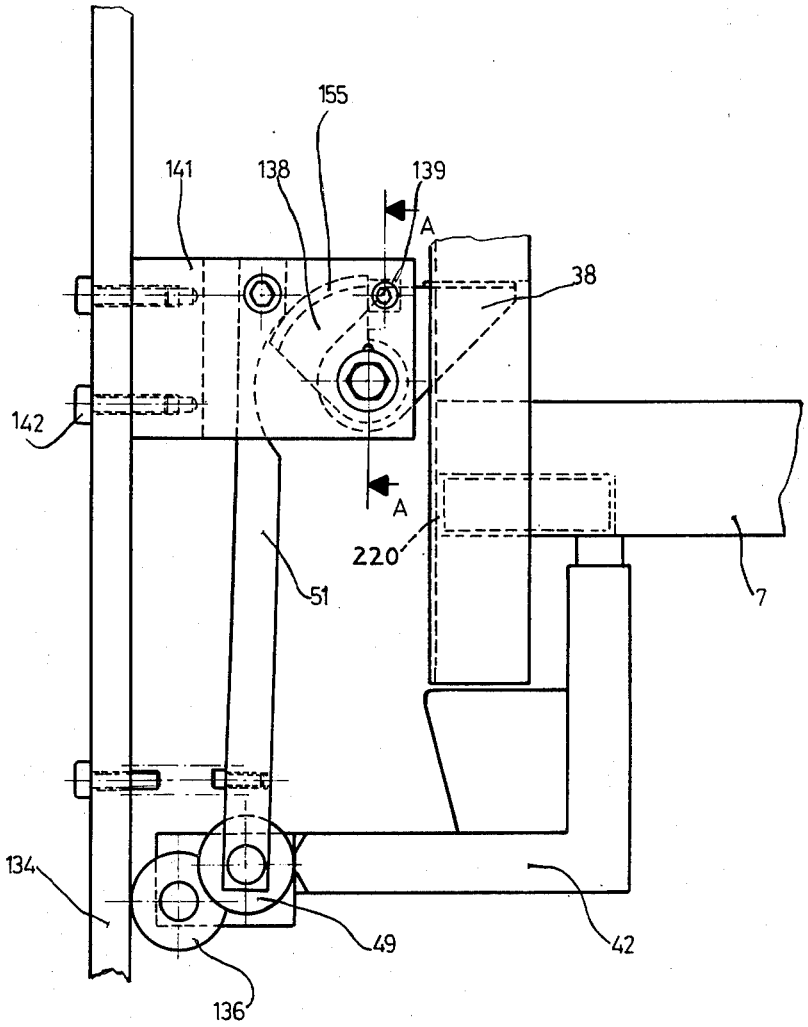

In operations as illustrated in FIGS. 29 and 30, the cam member 44 engages the stop or retainer 38 and rotates it in a counterclockwise direction (FIG. 30). While in this position the layer 155 of the segment 138 is frictionally engaged in the recess 144 to hold the retainer 138 in a retracted position. It should be noted that to urge the lever in a counterclockwise direction around its pivot mounting 143, a compression spring 145 extends berween a threaded fastener 146 in the member 134 and a stud 147 on the lever 51 adjacent the cam follower 49. As the pusher 42 is lowered, its cam surface 47 engages the follower 49 to rotate the arm 51 in a clockwise direction. Such rotation releases the engagement between the recess 144 and the layer 155 on the segment 138 so that the spring 140 rotates the shaft 137 in a clockwise direction to move the retainer 38 to the extended position illustrated in FIG. 31. It is noted that this rotation occurs after the pusher 42 has lowered the pallet 7 so that the stop 38 will not engage the member 220 of the pallet which is engaged by the pusher 42 but will engage the next pallet.

Figure 33:
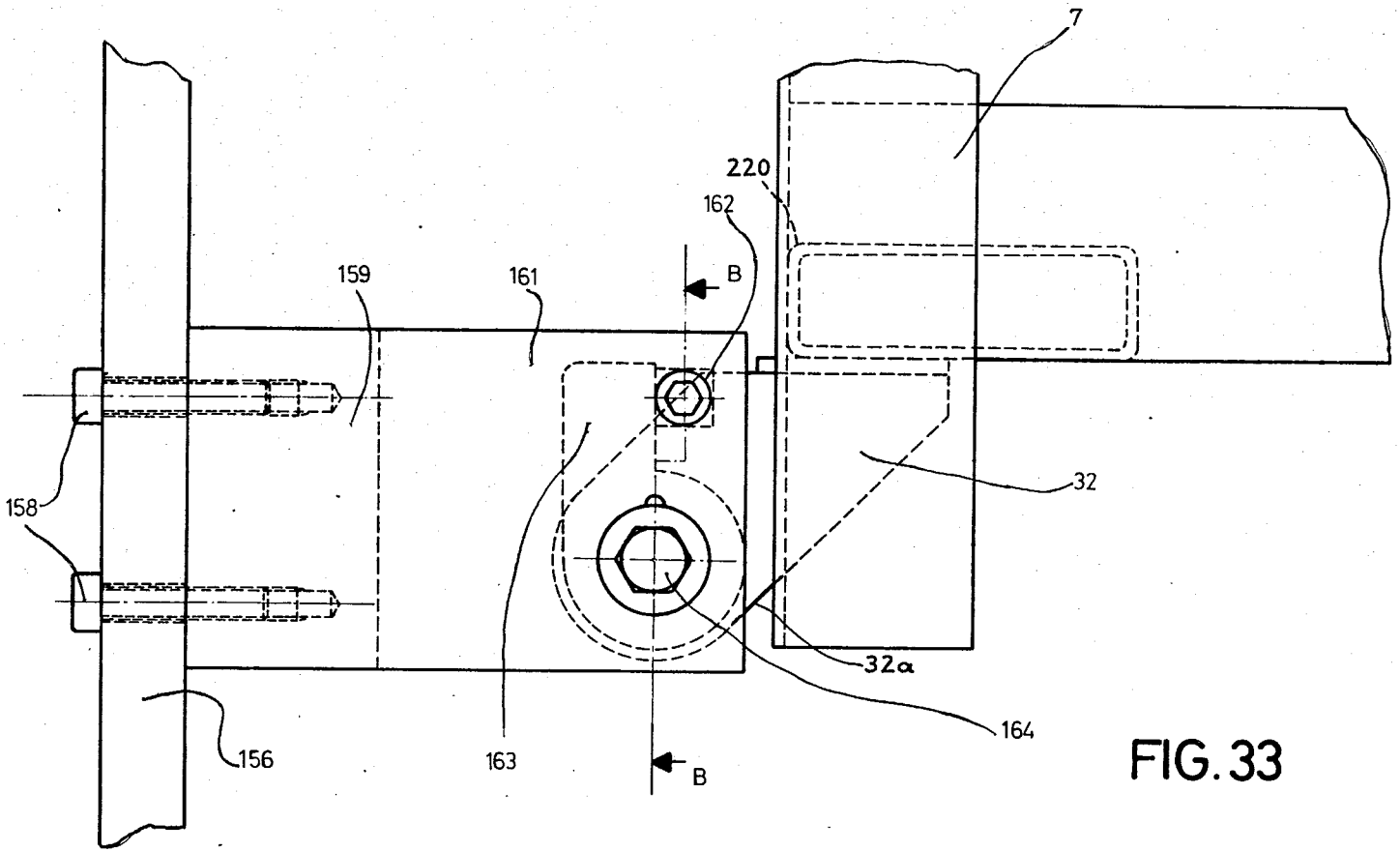
FIG. 33 is a detailed view of the pallet retaining device on a stacking station.
Figure 34:
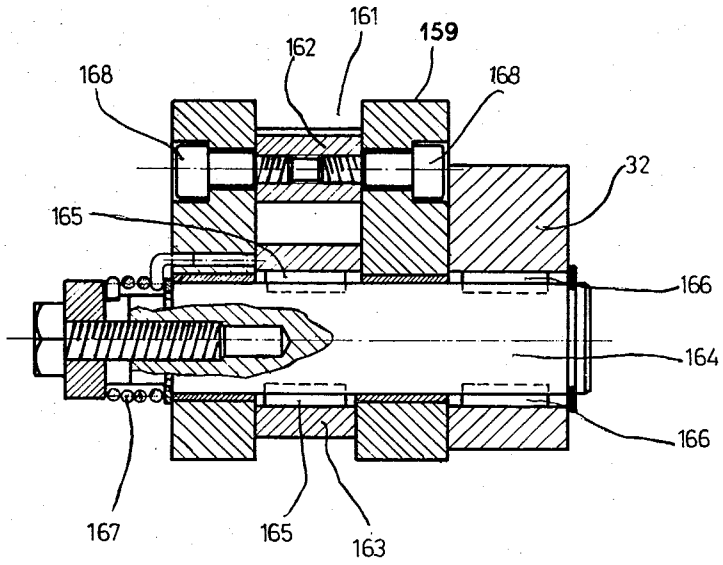
FIG. 34 is a cross-sectional view taken along lines B—B of FIG. 33.

The retainers such as 32 in the stacking device does not have means for holding it in the retracted position. As best illustrated in FIGS. 33 and 34, the retainer 32 is secured on a shaft 164 by a key 166 (FIG. 34). The shaft 164 is mounted for rotation in bifurcated portion 161 of a member 159 which is secured by screws 158 on a frame member such as 156 (FIG. 33) at the stacking station. A stop 162 is secured by screws 168 in the bifurcated portion and the stop 162 is engaged by a member or lever 63, which is keyed on the shaft 164 by keys such as 65 (FIG. 34). As with the retainer 38, a spring 167 is provided on the shaft or axle 164 to urge it in a clockwise direction and to the extended position with the lever 163 engaged on the stop. When forming a stack as illustrated in FIGS. 7–12 a portion such as 220 of the pallets 7 will engage a lower edge **32*a* of the retainer 32 and urge the retainer to a retracted position until the pallet has been moved therepassed. After clearing the portion 220 of the pallet 7, the spring will urge the retainer 32** to the extended or stopping position.

In the above discussion of the preferred embodiment, means for stacking the full pallets into stacks of full pallets, means for unstacking the full pallets, means for stacking empty pallets and means for unstacking empty pallets are included in the system in order to save space. It is within the scope of this invention that stacking stations such as the stacking station for empty pallets and the unstacking stations for empty pallets may be dispensed with if desired.

While the first stacking station 10 was described, the second stacking station 23 will have the same structure. Also, the first unstacking station 20 will have the same structure as the described second unstacking station 8.

While the controls have not been described, the entire system may be controlled by an operator who actuates various devices for performing various of the above described operations. It is also possible to automate the system by utilizing various controls with various switches which are actuated as the device accomplishes a given function.

Although various minor modifications may be suggested by those versed in the art, it should be understood that I wish to embody within the scope of the patent warranted hereon, all such modifications as reasonably and properly come within the scope of my contribution to the art.

I claim:

1. In a system for producing folded boxes including means for printing sheets of material with the configuration of the boxes, means for die cutting box blanks from the printed sheets of material and producing piles of box blanks, means for folding and gluing each box blank to form a folded box, and means for packing the folded boxes, the improvement comprising means for transferring piles of box blanks between a discharge of the means for die cutting and a receiving station of the means for folding and gluing, said means for transferring comprising means for loading at least one pile of box blanks onto an empty pallet to form a loaded pallet, means for conveying a loaded pallet to a first stacking station having means for stacking the loaded pallet with at least one other loaded pallet to form a stack of loaded pallets, means for conveying a stack of loaded pallets to a storage area, means for removing a stack of loaded pallets from the storage area and transporting the stack to a first unstacking station having means for removing a loaded pallet from the stack successively and transporting each loaded pallet individually to an unloading station, means for unloading each of the piles disposed on the loaded pallet to form an empty pallet and transporting the piles to the receiving station, means for conveying each of the empty pallets to a second stacking station having means for stacking the empty pallets into a stack of empty pallets, means for conveying the stack of empty pallets from the second stacking station to a second unstacking station having means for unstacking unloaded pallets from a stack of unloaded pallets and transporting the unloaded pallets to the means for loading piles thereon.

2. In a system according to claim 1, wherein the means for loading at least one pile of box blanks onto an empty pallet comprises a fork arrangement, means supporting said fork arrangement for moving in a lengthwise direction and in a vertical direction, said means for supporting including a carriage movable laterally in a sub-frame by a linear motor.

3. In a system according to claim 2, wherein the means for moving the fork in a vertical direction comprises a plurality of levers pivotally connected between the sub-frame and a main frame, said levers being interconnected and actuated by a pneumatic cylinder so that during actuation of the cylinder, said sub-frame is raised vertically relative to the main frame.

4. In a system according to claim 2, wherein the means for unloading each of the piles from a pallet comprises a fork arrangement with means for shifting the fork in both a linear direction and a vertical direction.

5. In a system according to claim 1, wherein the means for conveying a loaded pallet and the means for conveying a stack of pallets each includes a track having a pair of lateral frame members supporting rollers, each of said rollers having means for applying a driving force thereto.

6. In a system according to claim 1, wherein the means for stacking disposed at each of said first and second stacking stations comprises a vertical frame having at least two laterally spaced frame members, a lift mechanism having at least two pushers supported in said frame for moving in a vertical path along said lateral frame members between a lower position and an upper position, each of said pushers having surfaces for acting on a lower part of a pallet adjacent each edge to lift the pallet from a lower position to an elevated position, means for moving said pushers between said lower and upper positions and including a rack and pinion arrangement, and at least two stops disposed on said frame at a given height for holding a pallet adjacent said elevated position, each of said stops being biased from a retracted position enabling passage of a pallet to an extended position for supporting a pallet so that as a pallet is lifted past said stops, said stops are moved to their retracted position.

7. In a system according to claim 1, wherein each of the means for unstacking disposed at the first and second unstacking stations includes a vertical frame, a lift mechanism including at least two pushers disposed on said vertical frame, means for moving the pushers between two vertical positions, said means for moving including a rack and pinion arrangement, a pair of stops disposed on said frame and being movable between a retracted position enabling passage of a pallet and an extended position preventing movement in a downward direction, each of said stops being biased to the extended position and having means holding it in the retracted position.

8. In a system according to claim 7, wherein the means for holding the stops in the retracted position includes a segment provided with a friction material coupled to said stop, said segment being engageable with a surface on a lever biased in engagement therewith.

9. In a system according to claim 7, wherein each of said pushers being provided with a control cam for releasing the holding means of said stop.

10. In a system according to claim 9, wherein each of said stops is mounted to rotate between said extended and retracted positions, said means for holding includes an arcuate segment coupled to said stop to rotate therewith, a cam lever pivotably mounted adjacent said segment having a machine recess matching said segment positioned to engage said segment, and said control cam urging said cam lever out of engagement with said segment to enable the stop to rotate to the extended position.

11. In a system according to claim 7, wherein each of the pushers is provided with a cam for engaging the stops to rotate them from an extended position to a retracted position.

12. In a system according to claim 1, wherein the conveyor adjacent each one of said stacking and unstacking stations includes a plurality of rollers and means for moving the rollers between an extended position within the path of the pallet and a retracted position clear of the pallet.

13. In a system according to claim 12, wherein the means for shifting rollers between an extended and retracted position includes a frame, each of said rollers being disposed on a shaft mounted for rotation in said frame, said frame being supported on the main frame adjacent the means for stacking for movement along a sliding guide, a plurality of levers interconnecting said frame to the main frame, a piston connected to one of said levers for shifting the frame between said positions, each of said shafts being provided with a sprocket wheel, a chain extending to said sprocket and means for rotating the chain to control the direction of movement of each of said rolls.

14. A method for feeding box blanks to a box blank processing machine from a shaping machine, said method comprising providing individual empty pallets from a stack of empty pallets, loading piles of box blanks received from the shaping machine onto the empty pallet to form a loaded pallet, stacking the loaded pallet with a given number of other loaded pallets to form a stack of loaded pallets, conveying the stack of loaded pallets into a storage station, removing a stack of loaded pallets from the storage station and conveying it to an unstacking station for loaded pallets, removing each of the loaded pallets from the stack of loaded pallets at the unstacking station sequentially and transporting each of the loaded pallets to an unloading station, unloading the piles of blanks from the pallets at the unloading station to empty the pallet, transporting each of the unloaded piles of blanks into a preparatory station proceeding the box blanks processing machine, transporting the empty pallet to a stacking station for empty pallets, stacking the empty pallet into a stack of empty pallets of a given number and then transporting the stack of empty pallets to the unstacking station for the empty pallets.

15. In a system for producing folded boxes including means for printing sheets of material with the configuration of the boxes, means for die cutting box blanks from the printed sheets of material and producing piles of box blanks, means for folding and gluing a box blank to form a folded box, and means for packing the folded boxes, the improvement comprising means for transferring piles of box blanks between a discharge of the means for die cutting and a receiving station of the means for folding and gluing the box blanks, said means for transferring comprising means for loading at least one pile of box blanks onto an empty pallet to form a loaded pallet, means for conveying the loaded pallet to a storage area of loaded pallets, means for removing a loaded pallet from the storage area and transporting the loaded pallet individually to an unloading station, means for unloading each of the piles disposed on the loaded pallet to form an empty pallet and transporting the piles to the receiving station, means for conveying each of the empty pallets to an empty pallet storage station containing a plurality of empty pallets and means for removing an empty pallet from the storage station and transporting the empty pallet individually to the means for loading piles thereon.

16. In a system according to claim 15, wherein the means for conveying the loaded pallets to a storage area of loaded pallets includes first means for stacking the loaded pallets with at least one other loaded pallet to form a stack of loaded pallets, means for conveying the stack of loaded pallets to the storage area, and wherein the means for removing a loaded pallet from the storage area includes means for transporting a stack of loaded pallets to first means for unstacking the loaded pallets one from the other and then transporting the loaded pallets individually to their unloading station.

17. In a system according to claim 15, wherein the means for conveying each of the empty pallets to the storage station for empty pallets includes second means for stacking the empty pallet with at least one other empty pallet, conveying the stack of empty pallets to the storage station, and wherein the means for removing empty pallets from the storage area includes second means for unstacking the empty pallets from a stack of empty pallets and transporting the empty pallets individually to the means for loading piles thereon.

18. In a system according to claim 17, wherein the means for conveying the loaded pallets to a storage area of loaded pallets includes first means for stacking the loaded pallets with at least one other loaded pallet to form a stack of loaded pallets, means for conveying the stack of loaded pallets to the storage area, and wherein the means for removing a loaded pallet from the storage area includes means for transporting a stack of loaded pallets to first means for unstacking the loaded pallets one from the other and then transporting the loaded pallets individually to their unloading station.

* * * * *